US012240029B2

(12) United States Patent
Whittaker et al.

(10) Patent No.: US 12,240,029 B2
(45) Date of Patent: Mar. 4, 2025

(54) BEVERAGE CONTAINER BODY, CAN END, AND MATERIAL THEREFOR

(71) Applicant: Ball Corporation, Westminster, CO (US)

(72) Inventors: Simon Whittaker, Westminster, CO (US); Julian Stock, Westminster, CO (US)

(73) Assignee: BALL CORPORATION, Westminster, CO (US)

( * ) Notice: Subject to any disclaimer, the term of this patent is extended or adjusted under 35 U.S.C. 154(b) by 0 days.

(21) Appl. No.: 17/874,622

(22) Filed: Jul. 27, 2022

(65) Prior Publication Data

US 2023/0035259 A1 Feb. 2, 2023

Related U.S. Application Data

(60) Provisional application No. 63/203,584, filed on Jul. 27, 2021.

(51) Int. Cl.

| | |
|---|---|
| ***B21D 51/26*** | (2006.01) |
| ***B65D 1/16*** | (2006.01) |
| ***B65D 17/28*** | (2006.01) |
| ***C22F 1/04*** | (2006.01) |

(52) U.S. Cl.

CPC ..... *B21D 51/2669* (2013.01); *B65D 1/165* (2013.01); *B65D 17/4012* (2018.01); *C22F 1/04* (2013.01); *B65D 2517/0014* (2013.01)

(58) Field of Classification Search

CPC ..... B21D 51/28; B21D 51/30; B21D 51/32; B21D 51/34

See application file for complete search history.

(56) References Cited

U.S. PATENT DOCUMENTS

| | | | | |
|---|---|---|---|---|
| 4,260,419 | A * | 4/1981 | Robertson | C22F 1/04 420/534 |
| 6,463,776 | B1 * | 10/2002 | Enoki | B21D 51/26 72/46 |
| 10,570,489 | B2 * | 2/2020 | Luckey, Jr. | B21D 35/005 |
| 10,975,461 | B2 | 4/2021 | Das et al. | |

OTHER PUBLICATIONS

N. Akhtar, et al., "Measurement of Dissolved Hydrogen in A1 Alloys and Calculation of Hydrogen Removal Efficiency of a Degassing System" SOAN Enterprises Islamabad, Pakistan; Department of Chemistry, University of Wah, Pakistan; Pakistan Journal of Chemistry 2011; pp. 185-189.

The Aluminum Association, Inc., "Registration Record Series Teal Sheets—International Alloy Designations and Chemical Composition Limits for Wrought Aluminum and Wrought Aluminum Alloys" Jan. 2015; 38 pages.

* cited by examiner

*Primary Examiner* — Jason L Vaughan

(74) *Attorney, Agent, or Firm* — Greer, Burns & Crain, Ltd.

(57) ABSTRACT

In a method of forming a beverage container, a can body is formed from a metal alloy. A can end is formed from a substantially compositionally identical metal alloy. The metal alloy is a heat treatable aluminum alloy. The heat treatable aluminum alloy is produced from up to 100% recycled aluminum material.

10 Claims, 27 Drawing Sheets

TABLE 1: UNIALLOY COMPOSITIONS

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 0.20 | 0.20 | 5.2-6.0 | 0.15-0.50 | 0.20-0.45 | 0.10 | 0.05 | 0.10 | 0.20 | | | | | | 0.003 | | | 0.05 | | 0.05 | 0.15 | Rem. |
| 0.35-0.8 | 0.30 | 1.5-2.5 | 0.20 | 0.50-1.0 | 0.20 | | 0.20 | 0.20 | | | | | | | | | | | 0.05 | 0.15 | Rem. |
| 0.20 | 0.20 | 5.5-6.5 | 0.10 | 0.50 | | | 0.10 | 0.05 | | | | | | | | | 0.30-0.50 | | 0.05 | 0.15 | Rem. |
| 0.8 | 0.7 | 3.5-5.0 | 1.0 | 0.20-1.0 | 0.10 | 0.20 | 0.50 | 0.20 | | | 0.20 | | | 1.0-2.0 | | | | | 0.05 | 0.15 | Rem. |
| 0.8-1.3 | 0.7 | 1.0-2.0 | 0.6-1.0 | 0.50-1.4 | | 0.20 | 0.20 | 0.30 | | | | | | | | | | | 0.05 | 0.15 | Rem. |
| 0.8 | 0.8 | 3.3-4.6 | 0.50-1.0 | 0.40-1.8 | 0.10 | 0.20 | 0.8 | 0.20 | | | 0.20 | | | 0.8-1.5 | 0.20 | | | | 0.10 | 0.30 | Rem. |
| 0.8 | 0.8 | 3.3-4.6 | 0.20-1.0 | 0.40-1.8 | 0.10 | 0.20 | 0.8 | 0.20 | | | 0.20 | | | 0.05 | 0.8-1.5 | | | | 0.10 | 0.30 | Rem. |
| 0.8 | 0.7 | 3.3-4.6 | 0.50-1.0 | 0.40-1.8 | 0.10 | 0.10 | 0.8 | 0.20 | | | 0.10 | | | 0.10 | 0.40-1.9 | | | | 0.05 | 0.15 | Rem. |
| 0.50-0.8 | 0.40 | 0.7-1.1 | 0.30 | 0.25-0.50 | 0.10 | | 0.25 | 0.10 | | | | | | | | 0.05 | | | 0.05 | 0.15 | Rem. |
| 0.25 | 0.05 | 3.2-4.4 | | 1.0-1.6 | | | 0.10 | | | | | | | | | | | 0.6 O | 0.05 | 0.15 | Rem. |
| 0.50 | 0.50 | 0.7-1.3 | 0.10-0.40 | 0.40-1.0 | 0.15 | | 0.30 | | | | | | | | | | | | 0.05 | 0.15 | Rem. |
| 0.40 | 0.7 | 5.0-6.0 | | | | | 0.30 | | | | 0.20-0.6 | | | 0.20-0.6 | | | | | 0.05 | 0.15 | Rem. |
| 0.40 | 0.50 | 4.5-6.0 | | | | | 0.30 | | | | 0.20-0.6 | | | 0.20-0.6 | | | | | 0.05 | 0.15 | Rem. |
| 0.40 | 0.7 | 5.0-6.0 | | | | | 0.30 | | | | 0.20-0.8 | | | | 0.10-0.50 | | | | 0.05 | 0.15 | Rem. |
| 0.40 | 0.7 | 5.0-6.0 | 0.15 | 0.15 | | | 0.30 | 0.05 | | | 0.20-0.6 | | | 0.05 | 0.20-0.6 | | | | 0.05 | 0.15 | Rem. |
| 0.30 | 0.50 | 4.6-6.0 | 0.05 | 0.05 | | | | | | | 0.30-0.6 | | | | 0.30-0.7 | | | | 0.05 | 0.15 | Rem. |
| 0.40 | 0.7 | 4.0-5.5 | | | | | 0.30 | | | | 0.20-0.7 | | | | 0.20-0.6 | | | | 0.05 | 0.15 | Rem. |
| 0.6-1.0 | 0.40 | 1.5-2.0 | 0.25 | 0.8-1.2 | 0.04-0.35 | | 0.25 | 0.15 | | | | | | | | | | | 0.05 | 0.15 | Rem. |
| 0.50-1.2 | 0.7 | 3.9-5.0 | 0.40-1.2 | 0.20-0.8 | 0.10 | | 0.25 | 0.15 | | | | | | | | | | | 0.05 | 0.15 | Rem. |
| 0.50-0.9 | 0.50 | 3.9-5.0 | 0.40-1.2 | 0.20-0.8 | 0.10 | 0.10 | 0.25 | 0.15 | | | | | | | | | | 0.20 Zr+Ti | 0.05 | 0.15 | Rem. |
| 0.50-1.2 | 0.30 | 3.9-5.0 | 0.40-1.2 | 0.20-0.8 | 0.10 | | 0.25 | 0.15 | | | | | | | | | | | 0.05 | 0.15 | Rem. |
| 0.8 | 0.8 | 3.9-5.2 | 0.30-1.0 | 0.30-1.3 | 0.15 | 0.20 | 0.7 | 0.20 | | | 0.40 | | | 0.20 | 0.7-1.5 | | | | 0.05 | 0.15 | Rem. |
| 0.30-0.7 | 0.15 | 3.5-4.5 | 0.10-0.50 | 0.30-0.8 | | | | 0.05-0.15 | 0.30-0.7 | | | | | | | | 0.10-0.25 | | 0.05 | 0.15 | Rem. |
| 0.20-0.8 | 0.7 | 3.5-4.5 | 0.40-1.0 | 0.40-0.8 | 0.10 | | 0.25 | 0.15 | | | | | | | | | | | 0.05 | 0.15 | Rem. |
| 0.20-0.8 | 0.7 | 3.5-4.5 | 0.40-1.0 | 0.40-1.0 | 0.10 | | 0.25 | | | | | | | | | | | 0.25 Zr+Ti | 0.05 | 0.15 | Rem. |
| 0.8 | 0.7 | 2.2-3.0 | 0.20 | 0.20-0.50 | 0.10 | | 0.25 | | | | | | | | | | | | 0.05 | 0.15 | Rem. |
| 0.9 | 1.0 | 3.5-4.5 | 0.20 | 0.45-0.9 | 0.10 | 1.7-2.3 | 0.25 | | | | | | | | | | | | 0.05 | 0.15 | Rem. |
| 0.9 | 1.0 | 3.5-4.5 | 0.20 | 1.2-1.8 | 0.10 | 1.7-2.3 | 0.25 | | | | | | | | | | | | 0.05 | 0.15 | Rem. |
| 0.10-0.25 | 0.9-1.3 | 1.9-2.7 | | 1.3-1.8 | | 0.9-1.2 | 0.10 | 0.04-0.10 | | | | | | | | | | | 0.05 | 0.15 | Rem. |

FIG. 15A

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 0.15-0.25 | 0.9-1.4 | 1.8-2.7 | 0.25 | 1.2-1.8 | | 0.8-1.4 | 0.15 | 0.20 | | | | | | | | | | 0.25 Zr+Ti | 0.05 | 0.15 | Rem. |
| 0.20 | 0.30 | 5.8-6.8 | 0.20- | 0.02 | | | 0.10 | 0.02- | | | | | | | | 0.05-0.15 | 0.10-0.25 | | 0.05 | 0.15 | Rem. |
| 0.20 | 0.30 | 5.8-6.8 | 0.20- | 0.02 | | | 0.10 | 0.10- | | | | | | | | 0.05-0.15 | 0.10-0.25 | | 0.05 | 0.15 | Rem. |
| 0.15 | 0.18 | 5.8-6.8 | 0.20- | 0.02 | | | 0.10 | 0.02- | | | | | | | | 0.05-0.15 | 0.10-0.25 | | 0.05 | 0.15 | Rem. |
| 0.25 | 0.30 | 5.3-6.4 | 0.10- | 0.05- | | | 0.10 | 0.02- | | | | | | | | 0.05-0.15 | 0.10-0.25 | 0.40 Si+Fe | 0.05 | 0.15 | Rem. |
| 0.20 | 0.30 | 5.8-6.8 | 0.20- | 0.02 | | | 0.10 | 0.02- | | | | | | | 0.03-0.08 | 0.05-0.15 | 0.10-0.25 | 0.05-0.20 Cd | 0.05 | 0.15 | Rem. |
| 0.15 | 0.20 | 4.5-5.5 | 0.15- | 0.10- | 0.05 | | 0.05- | 0.15 | | | | | | | | | | | 0.05 | 0.15 | Rem. |
| 0.10 | 0.15 | 3.6-4.5 | 0.30 | 1.0-1.6 | 0.10 | | | 0.05 | | | | | | | | | 0.05-0.15 | 0.01-0.06 Sc | 0.05 | 0.15 | Rem. |
| 0.50 | 0.50 | 3.8-4.9 | 0.30- | 1.2-1.8 | 0.10 | | 0.25 | 0.15 | | | | | | | | | | | 0.05 | 0.15 | Rem. |
| 0.15 | 0.20 | 3.7-4.5 | 0.15- | 1.2-1.5 | 0.10 | | 0.25 | 0.15 | | | | | | | | | | | 0.05 | 0.15 | Rem. |
| 0.20 | 0.30 | 3.8-4.9 | 0.30- | 1.2-1.8 | 0.10 | | 0.25 | 0.15 | | | | | | | | | | | 0.05 | 0.15 | Rem. |
| 0.12 | 0.15 | 3.8-4.4 | 0.30- | 1.2-1.8 | 0.10 | | 0.25 | 0.15 | | | | | | | | | | | 0.05 | 0.15 | Rem. |
| 0.10 | 0.15 | 3.8-4.5 | 0.40- | 1.2-1.6 | | 0.05 | 0.10 | 0.01- | | | | | | | | | | | 0.05 | 0.15 | Rem. |
| 0.10 | 0.12 | 3.8-4.4 | 0.30- | 1.2-1.8 | 0.10 | | 0.25 | 0.15 | | | | | | | | | | | 0.05 | 0.15 | Rem. |
| 0.10 | 0.12 | 3.8-4.4 | 0.30- | 1.2-1.6 | | | 0.20 | 0.10 | | | | | | | | | | | 0.05 | 0.15 | Rem. |
| 0.06 | 0.12 | 4.0-4.5 | 0.45- | 1.2-1.6 | 0.05 | | 0.15 | 0.10 | | | | | | | | | | | 0.05 | 0.15 | Rem. |
| 0.08 | 0.08 | 3.8-4.3 | 0.45- | 1.2-1.6 | 0.05 | | 0.15 | 0.10 | | | | | | | | | | | 0.05 | 0.15 | Rem. |

FIG. 15B

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS | | Al |
|---|---|---|---|---|---|---|---|---|---|---|---|---|---|---|---|---|---|---|---|---|---|
| | | | | | | | | | | | | | | | | | | | Each | Total | Minimum |
| 0.15 | 0.20 | 3.8-4.9 | 0.30- | 1.2-1.8 | | | 0.25 | 0.06 | | | | | | | | | 0.08-0.14 | | 0.05 | 0.15 | Rem. |
| 0.08 | 0.11 | 3.7-4.3 | 0.50- | 1.1-1.6 | 0.05 | | 0.25 | 0.15 | | | | | | | | | | | 0.05 | 0.15 | Rem. |
| 0.50-1.2 | 1.0 | 3.9-5.0 | 0.40- | 0.05 | 0.10 | | 0.25 | 0.15 | | | | | | | | | | | 0.05 | 0.15 | Rem. |
| 0.05 | 0.07 | 3.6-4.3 | 0.30- | 1.0-1.6 | | | 0.10 | 0.06 | | | | | | | | | 0.05-0.25 | | 0.05 | 0.15 | Rem. |
| 0.12 | 0.15 | 3.9-4.9 | 0.50- | 1.0-1.5 | | | 0.20 | 0.08 | | | | | | | | | 0.05-0.15 | | 0.05 | 0.15 | Rem. |
| 0.8 | 0.8 | 3.3-4.6 | 0.50- | 0.40-1.8 | 0.10 | 0.20 | 0.8 | 0.20 | | | 0.10-1.0 | | | 1.0 | 0.10-1.0 | | | | 0.10 | 0.30 | Rem. |
| 0.8 | 0.7 | 3.3-4.5 | 0.20- | 0.50-1.3 | 0.10 | 0.10 | 0.50 | 0.20 | | | 0.50-0.7 | | | 0.20-0.40 | | | | | 0.05 | 0.15 | Rem. |
| 0.8 | 0.8 | 3.3.-4.6 | 0.50- | 0.40-1.8 | 0.10 | 0.10 | 0.8 | 0.20 | | | 0.50-0.7 | | | 0.20-0.40 | | | | | 0.05 | 0.15 | Rem. |
| 0.8 | 0.7 | 3.3-5.0 | 0.20- | 0.50-1.3 | 0.10 | | 0.50 | 0.20 | | | 0.40-1.0 | | | 0.05 | 0.20-1.0 | | | | 0.10 | 0.30 | Rem. |
| 0.12 | 0.15 | 3.2-4.0 | 0.20- | 0.8-1.1 | | | | 0.10 | 0.30-0.50 | | | | | | | | 0.08-0.15 | | 0.05 | 0.15 | Rem. |
| 0.8 | 0.7 | 3.3-4.5 | 0.20- | 0.50-1.3 | 0.10 | | 0.50 | 0.20 | | | 0.20 | | | 0.8-1.5 | | | | | 0.10 | 0.30 | Rem. |
| 0.50-1.3 | 0.6-1.2 | 1.8-2.8 | 0.50 | 0.6-1.2 | | 0.6-1.4 | 0.20 | 0.20 | | | | | | | | | | | 0.05 | 0.15 | Rem. |
| 0.50-1.3 | 0.6-1.5 | 1.5-2.5 | 0.20 | 1.2-1.8 | | 0.6-1.4 | 0.20 | 0.20 | | | | | | | | | | | 0.05 | 0.15 | Rem. |
| 0.10 | 0.12 | 4.2-4.8 | 0.8-1.3 | 1.3-1.9 | 0.05 | | 0.20 | 0.15 | | | | | | | | | 0.08-0.15 | | 0.05 | 0.15 | Rem. |
| 0.50 | 0.50 | 2.2-3.0 | 0.10- | 0.30-0.6 | 0.10 | | 0.25 | 0.15 | | | | | | | | | | | 0.05 | 0.15 | Rem. |
| 0.50 | 0.50 | 1.4-2.2 | 0.10- | 0.30-0.8 | 0.10 | | 0.25 | 0.15 | | | | | | | | 0.05 | | | 0.05 | 0.15 | Rem. |
| 0.50-1.3 | 0.6 | 0.8-1.8 | 0.10- | 0.40-1.0 | 0.20 | | 0.50 | 0.15 | | | | 0.05 | | | | 0.05 | | | 0.05 | 0.15 | Rem. |
| 0.20 | 0.30 | 4.5-5.5 | 0.20- | 0.40-0.8 | | | | 0.15 | 0.05-0.50 | | | | | | | | 0.10-0.25 | | 0.05 | 0.15 | Rem. |
| 0.10 | 0.15 | 4.5-5.5 | 0.20- | 0.20-0.8 | 0.05 | | 0.25 | 0.15 | 0.15-0.6 | | | | | | | 0.05 | | | 0.05 | 0.15 | Rem. |
| 0.08 | 0.10 | 4.8-5.4 | 0.45- | 0.7-1.1 | | | 0.25 | 0.06 | 0.40-0.7 | | | | | | | | 0.08-0.15 | 0.0001 Be | 0.05 | 0.15 | Rem. |
| 0.40 | 0.7 | 5.0-6.0 | | | | | 0.30 | | | | 0.50-0.7 | | | 0.05 | 0.50-0.7 | | | | 0.05 | 0.15 | Rem. |
| 0.8 | 0.7 | 3.3-4.5 | 0.20- | 0.50-1.3 | 0.10 | 0.10 | 0.50 | 0.20 | | | 0.20-0.40 | | | 0.05 | 0.9-1.3 | | | | 0.05 | 0.15 | Rem. |
| 0.8 | 0.8 | 3.3-4.6 | 0.50- | 0.40-1.8 | 0.10 | 0.10 | 0.8 | 0.20 | | | 0.20-0.40 | | | 0.05 | 0.9-1.3 | | | | 0.05 | 0.15 | Rem. |
| 0.08 | 0.10 | 3.2-3.9 | 0.20- | 0.20-0.6 | 0.05 | 0.05 | 0.25 | 0.10 | 0.20-0.7 | | | 0.05 | 0.7-1.3 | | | 0.05 | 0.06-0.14 | | 0.05 | 0.15 | Rem. |

FIG. 15C

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 0.07 | 0.10 | 3.2-4.2 | 0.10-0.50 | 0.20-0.6 | | | 0.30-0.7 | 0.10 | 0.20-0.7 | | | | 1.0-1.3 | | | | 0.05-0.15 | | 0.05 | 0.15 | Rem. |
| 0.10 | 0.12 | 3.3-4.3 | 0.10-0.50 | 0.6-1.4 | | | 0.40-0.8 | | | | | | | | | | | | 0.05 | 0.15 | Rem. |
| 0.07 | 0.07 | 3.4-4.5 | 0.10-0.50 | 0.6-1.1 | | | 0.30-0.50 | 0.10 | 0.05-0.50 | | | | 0.6-0.9 | | | | 0.05-0.15 | | 0.05 | 0.15 | Rem. |
| 0.10 | 0.10 | 3.8-4.7 | 0.15-0.50 | 0.25-0.8 | | | 0.30 | 0.10 | 0.15-0.50 | | | | 0.8-1.5 | | | | 0.05-0.15 | | 0.05 | 0.15 | Rem. |
| 0.12 | 0.15 | 2.9-3.8 | 0.10-0.50 | 0.05-0.40 | | | 0.10-0.50 | 0.10 | | | | | 1.0-1.4 | | | | 0.05-0.15 | | 0.05 | 0.15 | Rem. |
| 0.10 | 0.10 | 2.0-2.7 | 0.15-0.50 | 0.20-0.8 | | | 0.30 | 0.10 | 0.15-0.40 | | | | 1.2-1.8 | | | | 0.05-0.16 | | 0.05 | 0.15 | Rem. |
| 0.10 | 0.12 | 2.4-3.0 | 0.05 | 0.25 | 0.05 | | 0.10 | 0.15 | | | | | 1.9-2.6 | | | | 0.08-0.15 | | 0.05 | 0.15 | Rem. |
| 0.20 | 0.30 | 1.8-2.5 | 0.10 | 1.1-1.9 | 0.10 | | 0.25 | 0.10 | | | | | 1.7-2.3 | | | | 0.04-0.16 | | 0.05 | 0.15 | Rem. |
| 0.12 | 0.15 | 4.4-5.2 | 0.25 | 0.25-0.8 | | | 0.25 | 0.10 | 0.25-0.6 | | | | 0.7-1.4 | | | | 0.04-0.18 | | 0.05 | 0.15 | Rem. |
| 0.12 | 0.15 | 3.9-4.6 | 0.25 | 0.25-0.8 | | | 0.25 | 0.10 | 0.25-0.6 | | | | 0.7-1.5 | | | | 0.04-0.18 | | 0.05 | 0.15 | Rem. |
| 0.12 | 0.15 | 3.7-4.3 | 0.25 | 0.25-0.8 | | | 0.25 | 0.10 | 0.25-0.6 | | | | 0.8-1.2 | | | | 0.08-0.16 | | 0.05 | 0.15 | Rem. |
| 0.08 | 0.08 | 3.9-4.5 | 0.10 | 0.25-0.8 | | | 0.25 | 0.10 | 0.10-0.50 | | | | 0.9-1.3 | | | | 0.05-0.15 | | 0.05 | 0.15 | Rem. |
| 0.12 | 0.15 | 2.5-3.3 | 0.35 | 0.25-0.8 | | | 0.35 | 0.10 | 0.25-0.6 | | | | 1.4-2.1 | | | | 0.04-0.18 | | 0.05 | 0.15 | Rem. |
| 0.12 | 0.15 | 2.1-2.8 | 0.05-0.50 | 0.20-0.8 | | ... | 0.25 | 0.10 | 0.25-0.6 | | | | 1.3-1.9 | | | | 0.04-0.18 | | 0.05 | 0.15 | Rem. |
| 0.12 | 0.15 | 2.5-3.1 | 0.10-0.6 | 0.35 | | | 0.35 | 0.15 | | | | | 1.2-1.8 | | | | 0.08-0.16 | | 0.05 | 0.15 | Rem. |
| 0.10 | 0.10 | 2.5-3.1 | 0.10-0.50 | 0.25 | | | 0.05 | 0.12 | | | | | 1.3-1.7 | | | | 0.08-0.15 | | 0.05 | 0.15 | Rem. |
| 0.10 | 0.10 | 2.5-3.1 | 0.10-0.50 | 0.25 | | | 0.05 | 0.12 | | | | | 1.1-1.7 | | | | 0.08-0.15 | | 0.05 | 0.15 | Rem. |
| 0.10 | 0.10 | 2.5-3.1 | 0.10-0.50 | 0.25 | | | 0.05-0.15 | 0.12 | | | | | 1.1-1.7 | | | | 0.08-0.15 | | 0.05 | 0.15 | Rem. |
| 0.12 | 0.15 | 3.2-3.8 | 0.35 | 0.25-0.8 | | | 0.35 | 0.10 | 0.25-0.6 | | | | 0.8-1.3 | | | | 0.04-0.18 | | 0.05 | 0.15 | Rem. |
| 0.08 | 0.10 | 2.9-3.5 | 0.50 | 0.25-0.8 | 0.05 | | 0.35 | 0.10 | 0.10-0.50 | | | | 0.8-1.1 | | | | 0.04-0.18 | | 0.05 | 0.15 | Rem. |
| 0.05 | 0.07 | 2.4-3.0 | 0.10-0.50 | 0.10-0.50 | | | 0.40-1.0 | 0.10 | | | | | 1.6-2.0 | | | | 0.05-0.12 | 0.0001 Be | 0.05 | 0.15 | Rem. |
| 0.05 | 0.07 | 2.3-2.9 | 0.10-0.50 | 0.05-0.40 | | | 0.20-0.9 | 0.10 | | | | | 1.4-1.8 | | | | 0.05-0.12 | 0.0001 Be | 0.05 | 0.12 | Rem. |

FIG. 15D

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 9.0-10.5 | 0.8 | 0.25 | 0.10 | 1.0-2.0 | | | 0.20 | | | | | | | | | | | | 0.05 | 0.15 | Rem. |
| 9.0-10.5 | 0.8 | 0.25 | 0.10 | 1.0-2.0 | | | 0.20 | | | | 0.02-0.20 | | | | | | | | 0.05 | 0.15 | Rem. |
| 0.8-1.2 | 0.50-0.8 | 0.10 | 0.05 | 0.01 | 0.20 | | 0.05 | | | | | | | | | | | | 0.05 | 0.15 | Rem. |
| 1.0-1.7 | 0.40-1.0 | 0.20 | 0.8-1.5 | 0.20 | 0.05-0.25 | 0.15-0.7 | 0.10 | 0.10 | | | | | | | | | | 0.05 Co | 0.05 | 0.15 | Rem. |
| 6.5-7.5 | 0.09 | 0.05 | 0.05 | 0.30-0.45 | | | 0.05 | 0.04-0.15 | | | | | | | | | | | 0.05 | 0.15 | Rem. |
| 4.5-5.5 | 0.20 | 1.0-1.5 | 0.10 | 0.45-0.6 | | | 0.10 | 0.20 | | | | | | | | | | | 0.05 | 0.15 | Rem. |
| 6.5-7.5 | 0.20 | 0.20 | 0.10 | 0.30-0.45 | | | 0.10 | 0.20 | | | | | | | | | | | 0.05 | 0.15 | Rem. |
| 3.5-4.5 | 0.35 | 0.05-0.20 | 0.03 | 0.05-0.20 | | | 0.05 | 0.02 | | | 0.6-1.5 | | | | | | | 0.05 Cd | 0.05 | 0.15 | Rem. |
| 1.4-2.2 | 0.7 | 0.20 | 0.35 | 0.30-0.8 | | | 0.20 | | | | | | | | | | | | 0.05 | 0.15 | Rem. |
| 1.4-2.2 | 0.7 | 0.20 | 0.6-1.2 | 0.10-0.50 | | | 0.20 | | | | | | | | | | | | 0.05 | 0.15 | Rem. |
| 1.4-2.2 | 0.7 | 0.35 | 0.6-1.2 | 0.10-0.50 | 0.05 | | 0.20 | 0.05 | | | | | | | | | | | 0.05 | 0.15 | Rem. |
| 1.8-2.2 | 0.7 | 0.10-0.50 | 0.6-1.2 | 0.10-0.50 | | | 0.20 | | | | | | | | | | | | 0.05 | 0.15 | Rem. |
| 1.4-2.2 | 0.7 | 0.20 | 0.6-1.2 | 0.10 | | | 0.50-1.3 | | | | | | | | | | | | 0.05 | 0.15 | Rem. |
| 0.6-1.6 | 0.7 | 0.10-0.50 | 0.6-1.2 | 0.10-0.50 | | | 0.20 | | | | | | | | | | | | 0.05 | 0.15 | Rem. |
| 6.5-7.5 | 0.20 | 0.05 | 0.10 | 0.50-0.8 | | | 0.10 | 0.20 | | | | | | | | | | | 0.05 | 0.15 | Rem. |

FIG. 15E

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 18.5-21.5 | 4.6-5.4 | | | | | 1.8-2.2 | | | | | | | | | | | | | 0.05 | 0.15 | Rem. |
| 2.5-3.5 | 0.20 | 0.03 | 0.8-1.2 | 0.01 | 0.01 | | | 0.005 | | 0.005 | | | | | | | 0.01 | 0.005 Na, 0.005 P | 0.02 | 0.10 | Rem. |
| 3.3-4.3 | 0.20-0.50 | 0.15 | 0.40-0.7 | 0.6-1.1 | 0.15 | | 0.25 | 0.10 | | | | | | 0.03 | | | | | 0.05 | 0.15 | Rem. |
| 9.0-11.5 | 0.50 | 2.5-3.5 | | 0.7-1.4 | | | 0.10 | 0.05 | | | 1.0-2.0 | | | | | | | | 0.05 | 0.15 | Rem. |
| 11.0-13.5 | 1.0 | 0.50-1.3 | | 0.8-1.3 | 0.10 | 0.50-1.3 | 0.25 | | | | | | | | | | | | 0.05 | 0.15 | Rem. |
| 4.5-6.0 | 0.8 | 0.30 | 0.05 | 0.05 | | | 0.10 | 0.20 | | | | | | | | | | | 0.05 | 0.15 | Rem. |
| 4.5-6.0 | 0.6 | 0.30 | 0.15 | 0.20 | | | 0.10 | 0.15 | | | | | | | | | | | 0.05 | 0.15 | Rem. |
| 4.7-6.0 | 0.8 | 0.30 | 0.05 | 0.15-0.30 | | | 0.10 | 0.20 | | | | | | | | | | | 0.05 | 0.15 | Rem. |
| 6.8-8.2 | 0.8 | 0.25 | 0.10 | | | | 0.20 | | | | | | | | | | | | 0.05 | 0.15 | Rem. |
| 3.6-4.6 | 0.8 | 0.10 | 0.05 | 0.10-0.30 | | | 0.10 | 0.15 | | | | | | | | | | | 0.05 | 0.15 | Rem. |
| 5.0-6.0 | 0.40 | 0.10 | 0.05 | 0.10-0.50 | | | 0.10 | 0.15 | | | | | | | | | | | 0.05 | 0.15 | Rem. |
| 7.8-9.2 | 0.8 | 0.25 | 0.10 | | | | 0.20 | | | | | | | | | | | | 0.05 | 0.15 | Rem. |
| 9.0-11.0 | 0.8 | 0.30 | 0.05 | 0.05 | | | 0.10 | 0.20 | | | | | | | | | | | 0.05 | 0.15 | Rem. |
| 9.3-10.7 | 0.8 | 3.3-4.7 | 0.15 | 0.15 | 0.15 | | 0.20 | | | | | | | | | | | | 0.05 | 0.15 | Rem. |
| 9.0-11.0 | 0.6 | 3.0-5.0 | 0.15 | 0.10 | | | 0.20 | 0.15 | | | | | | | | | | | 0.05 | 0.15 | Rem. |
| 9.0-11.0 | 0.50 | 0.03 | 0.40 | 0.20-0.50 | | | 0.10 | 0.15 | | | | | | | | | | | 0.05 | 0.15 | Rem. |
| 11.0-13.0 | 0.8 | 0.30 | 0.15 | 0.10 | | | 0.20 | | | | | | | | | | | | 0.05 | 0.15 | Rem. |
| 11.0-13.0 | 0.6 | 0.30 | 0.15 | 0.10 | | | 0.20 | 0.15 | | | | | | | | | | | 0.05 | 0.15 | Rem. |
| 11.0-13.0 | 0.8 | 0.25 | 0.10 | 0.10-0.50 | | | 0.20 | | | | | | | | | | | | 0.05 | 0.15 | Rem. |

FIG. 15F

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 0.30-0.7 | 0.50 | 0.10 | 0.03 | 0.35-0.8 | 0.03 | | 0.10 | | | 0.06 | | | | | | | | | 0.03 | 0.10 | Rem. |
| 0.30-0.7 | 0.40 | 0.05 | | 0.40-0.9 | | | | | | | | | | | | | | | 0.03 | 0.10 | Rem. |
| 0.30-0.6 | 0.10-0.30 | 0.05 | 0.05 | 0.35-0.6 | | | 0.10 | | | | | | | | | | | | 0.03 | 0.10 | Rem. |
| 0.50-0.9 | 0.50 | 0.10 | 0.03 | 0.6-0.9 | 0.03 | | 0.10 | | | 0.06 | | | | | | | | | 0.03 | 0.10 | Rem. |
| 0.50-0.7 | 0.50 | 0.04 | | 0.6-0.9 | | | | | | 0.06 | | | | | | | | | 0.03 | 0.10 | Rem. |
| 0.35-0.7 | 0.04 | 0.05-0.20 | 0.03 | 0.35-0.7 | | | 0.04 | 0.01 | | | | | | | | | | | 0.01 | | Rem. |
| 0.20-0.6 | 0.35 | 0.20 | 0.05-0.20 | 0.20-0.6 | 0.05 | | 0.15 | 0.15 | | | | | | | | | | | 0.05 | 0.15 | Rem. |
| 0.6-0.9 | 0.25 | 0.10-0.25 | 0.10-0.20 | 0.45-0.7 | 0.05 | | | 0.08 | | | | | | | | | 0.09-0.14 | | 0.05 | 0.15 | Rem. |
| 0.35-1.0 | 0.6 | 0.10 | 0.8 | 0.8-1.5 | 0.35 | | 0.20 | 0.10 | | | | | | | | | | | 0.05 | 0.15 | Rem. |
| 0.35-1.0 | 0.6 | 0.20-0.30 | 0.8 | 0.8-1.5 | 0.35 | | 0.20 | 0.10 | | | | | | | | | | | 0.05 | 0.15 | Rem. |
| 0.6-0.9 | 0.35 | 0.10 | 0.10 | 0.40-0.6 | 0.10 | | 0.10 | 0.10 | | | | | | | | | | | 0.05 | 0.15 | Rem. |
| 0.50-0.9 | 0.35 | 0.30 | 0.50 | 0.40-0.7 | 0.30 | | 0.20 | 0.10 | | | | | | | | | | 0.12-0.50 Mn+Cr | 0.05 | 0.15 | Rem. |
| 0.45-0.8 | 0.30 | 0.10 | 0.10 | 0.40-0.8 | 0.10 | | 0.10 | 0.10 | | | | | | | | | | | 0.05 | 0.15 | Rem. |
| 0.40-0.9 | 0.35 | 0.35 | 0.50 | 0.40-0.8 | 0.30 | | 0.25 | 0.10 | | | | | | | | | | 0.50 Mn+Cr | 0.05 | 0.15 | Rem. |
| 0.6-1.0 | 0.35 | 0.10 | 0.15 | 0.45-0.8 | 0.10 | | 0.10 | 0.10 | | | | | | | | | | | 0.05 | 0.15 | Rem. |
| 0.6-0.9 | 0.7 | 0.20 | 0.05-0.15 | 0.40-0.6 | 0.05-0.15 | | 0.25 | 0.15 | | | | | | | | | 0.05-0.15 | | 0.05 | 0.15 | Rem. |
| 0.6-1.0 | 0.35 | 0.10 | 0.15 | 0.45-0.8 | 0.15 | | 0.10 | 0.10 | | | | | | | | | | 0.12-0.20 Mn+Cr | 0.05 | 0.15 | Rem. |
| 0.20-0.6 | 0.35 | 0.15-0.30 | 0.05-0.20 | 0.45-0.9 | 0.10 | | 0.10 | 0.10 | | | | | | | | | | | 0.05 | 0.15 | Rem. |
| 0.30-0.6 | 0.35 | 0.25 | 0.05-0.20 | 0.40-0.8 | 0.20 | | 0.10 | | | | | | | | | | | | 0.05 | 0.10 | Rem. |
| 0.35-0.7 | 0.35 | 0.20-0.50 | 0.13-0.30 | 0.45-0.8 | 0.10 | | 0.20 | 0.10 | | | | | | | | | | | 0.05 | 0.15 | Rem. |
| 0.20-0.6 | 0.10 | 0.05-0.16 | 0.10-0.40 | 0.45-0.9 | | | 0.05 | 0.05 | | | | | | | | | | | 0.05 | 0.15 | Rem. |
| 0.50-0.9 | 0.35 | 0.30 | 0.30 | 0.40-0.7 | 0.30 | | 0.20 | 0.10 | | | | | | | | 0.05-0.20 | | | 0.05 | 0.15 | Rem. |
| 0.6-1.0 | 0.50 | 0.15-0.6 | 0.20-0.8 | 0.40-0.8 | 0.10 | | 0.25 | 0.10 | | | | | | | | | | | 0.05 | 0.15 | Rem. |
| 0.8-1.2 | 0.50 | 0.15-0.6 | 0.20-0.8 | 0.6-1.0 | 0.10 | | 0.25 | 0.10 | | | | | | | | | | | 0.05 | 0.15 | Rem. |
| 0.7-1.5 | 0.8 | 0.20-0.7 | 0.20-0.7 | 0.50-1.1 | 0.04-0.25 | | 0.30 | 0.15 | | | | | | | | | | | 0.05 | 0.15 | Rem. |
| 0.7-1.1 | 0.50 | 0.30-0.8 | 0.30-0.9 | 0.7-1.1 | 0.05-0.25 | | 0.20 | | | | | | | | | | | 0.20 Zr+Ti | 0.05 | 0.15 | Rem. |
| 0.6-1.2 | 1.0 | 0.40-0.9 | 0.8 | 0.6-1.2 | 0.30 | 0.20 | 1.5 | 0.20 | | | | | | | | | | | 0.05 | 0.15 | Rem. |
| 0.6-1.1 | 0.40 | 0.50-0.9 | 0.10-0.45 | 0.50-1.0 | 0.10 | | 0.15 | 0.10 | | | | | | | | | | | 0.05 | 0.15 | Rem. |
| 0.6-1.4 | 0.50 | 0.10 | 0.40-1.0 | 0.6-1.2 | 0.30 | | 0.30 | 0.20 | | | 0.7 | | | 0.40-2.0 | | | | | 0.05 | 0.15 | Rem. |
| 0.6-1.4 | 0.50 | 0.40 | 0.20-1.0 | 0.6-1.2 | 0.30 | | 0.30 | 0.20 | | | 0.7 | | | | 0.40-2.0 | | | | 0.05 | 0.15 | Rem. |
| 0.6-1.0 | 0.50 | 0.6-1.1 | 0.20-0.8 | 0.8-1.2 | 0.10 | | 0.25 | 0.10 | | | | | | | | | | | 0.05 | 0.15 | Rem. |
| 0.6-1.0 | 0.30 | 0.6-1.1 | 0.10-0.6 | 0.8-1.2 | 0.10 | | 0.25 | 0.10 | | | | | | | | | | 0.05-0.50 O | 0.05 | 0.15 | Rem. |
| 0.30-0.6 | 0.35 | 0.25 | 0.05-0.20 | 0.40-0.8 | 0.20 | | 0.10 | 0.10 | | | | | | | | 0.05-0.20 | | | 0.05 | 0.15 | Rem. |
| 0.20-0.40 | 0.10-0.30 | 0.10-0.25 | 0.10 | 0.8-1.1 | 0.10 | | 0.10 | 0.10 | | | | | | | | | | | 0.05 | 0.15 | Rem. |
| 1.0-1.5 | 0.50 | 0.20 | 0.20 | 0.25-0.6 | 0.10 | | 0.20 | 0.15 | | | | | | | | | | | 0.05 | 0.15 | Rem. |
| 0.9-1.5 | 0.50 | 0.25 | 0.20 | 0.20-0.6 | 0.10 | | 0.20 | 0.15 | | | | | | | | | | | 0.05 | 0.15 | Rem. |
| 0.9-1.3 | 0.25 | 0.20 | 0.15 | 0.25-0.6 | 0.15 | | 0.20 | 0.15 | | | | | | | | | | | 0.05 | 0.15 | Rem. |
| 0.50-1.2 | 0.7 | 0.15-0.40 | 0.30-0.8 | 0.6-1.2 | 0.10 | | 0.30 | 0.20 | | | 0.40-0.7 | | | 0.40-1.2 | | | | | 0.05 | 0.15 | Rem. |
| 0.6-1.0 | 0.50 | 0.20-0.6 | 0.10 | 0.8-1.2 | 0.05-0.35 | | 0.40-1.0 | 0.15 | | | | | | | | | | | 0.05 | 0.15 | Rem. |
| 0.40-0.9 | 0.50 | 0.30-0.9 | 0.35 | 0.6-1.2 | 0.15 | | 0.20 | 0.15 | | | | | | 0.05 | 0.9-1.5 | | | | 0.05 | 0.15 | Rem. |

FIG. 15G

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 0.6-1.5 | 0.40 | 0.20 | 0.40-1.0 | 0.8-1.5 | 0.25 | | 0.20 | 0.10 | | | | | | | 0.6-1.5 | | | | 0.05 | 0.15 | Rem. |
| 0.8-1.5 | 0.05-0.20 | 0.01-0.11 | 0.02-0.10 | 0.45-0.7 | 0.10 | | 0.25 | 0.15 | | | | | | | | | | | 0.05 | 0.15 | Rem. |
| 0.6-1.4 | 0.50 | 0.20-0.50 | 0.20-0.6 | 0.40-0.9 | | ... | | | | | 0.30-0.8 | | | | 0.6-1.2 | | | | 0.05 | 0.15 | Rem. |
| 0.7-1.3 | 0.05-0.7 | 0.30-0.9 | 0.30-1.2 | 0.30-1.0 | 0.20 | | 0.20 | 0.20 | | | | | | | | | | | 0.05 | 0.15 | Rem. |
| 0.8-1.5 | 0.7 | 0.20-0.7 | 0.6-1.4 | 2.1-3.0 | 0.20 | | 0.50 | 0.20 | | | | | | | | | | | 0.05 | 0.15 | Rem. |
| 0.6-1.4 | 0.7 | 0.20-0.50 | 0.20-1.0 | 0.6-1.2 | 0.30 | | 0.30 | 0.20 | | | 0.50-1.5 | | | 0.40 | 0.05 | | | | 0.05 | 0.15 | Rem. |
| 0.55-0.8 | 0.30 | 0.15 | 0.10-0.30 | 0.8-1.1 | 0.10 | | 0.10-0.30 | 0.15 | | | | | | | | | | | 0.15 | 0.15 | Rem. |
| 1.0-1.3 | 0.50 | 0.25-0.40 | 0.6-0.9 | 0.7-1.0 | 0.04-0.10 | | 0.30 | 0.20 | | | 0.6-0.8 | | | | 0.6-0.8 | | | | 0.05 | 0.15 | Rem. |
| 0.50-0.8 | 0.25 | 0.10-0.25 | 0.40-0.6 | 0.6-0.8 | 0.10-0.20 | | 0.05 | 0.05 | | | | | | | | | | | 0.03 | 0.15 | Rem. |
| 0.45-0.7 | 0.25 | 0.03 | 0.10-0.20 | 0.45-0.7 | 0.03 | | 0.05 | 0.08 | | | | | | | | | | | 0.03 | 0.15 | Rem. |
| 0.8-1.3 | 0.50 | 0.40-1.0 | 0.05 | 0.7-1.3 | 0.10 | | 0.50-1.0 | 0.15 | | | 0.30-1.0 | | | 0.05 | | | | | 0.05 | 0.15 | Rem. |
| 0.40-0.8 | 0.7 | 0.20-0.8 | 0.15 | 0.8-1.2 | 0.15 | | 0.25 | 0.15 | | | 0.15-0.7 | | | | 0.30-1.2 | | | | 0.05 | 0.15 | Rem. |
| 0.50-0.9 | 0.15-0.7 | 0.15-0.6 | 0.05-0.20 | 0.8-1.2 | 0.05-0.15 | | 0.25 | 0.15 | | | 0.30-0.9 | | | | 0.35-1.2 | | | | 0.05 | 0.15 | Rem. |
| 0.50-1.2 | 0.7 | 0.20-0.6 | 0.40 | 0.7-1.2 | 0.04-0.35 | | 0.25 | 0.15 | | | 0.20-0.8 | | | 0.15-0.40 | | | | | 0.05 | 0.15 | Rem. |
| 0.40-0.9 | 0.50 | 0.30-0.9 | 0.35 | 0.6-1.2 | 0.15 | | 0.20 | 0.15 | | | 0.40-0.7 | | | | 0.20-0.40 | | | | 0.05 | 0.15 | Rem. |
| 0.6-1.2 | 1.0 | 0.35 | 0.20 | 0.45-0.8 | 0.15-0.35 | | 0.25 | 0.15 | | ... | | | | | | | | | 0.05 | 0.15 | Rem. |
| 0.7-1.3 | 0.50 | 0.10 | 0.40-0.8 | 0.40-0.8 | | | 0.20 | 0.20 | | | | | | | | | | .. | 0.05 | 0.15 | Rem. |
| 0.7-1.3 | 0.50 | 0.10 | 0.40-0.8 | 0.40-0.8 | | | 0.20 | 0.20 | | | | | | 0.003 | | | | | 0.05 | 0.15 | Rem. |
| 0.6-1.0 | 0.40 | 0.40 | 0.05-0.40 | 0.40-0.8 | 0.10 | | 0.15 | | | | | | | | | 0.10 | | | 0.05 | 0.15 | Rem. |
| 0.20-0.50 | 0.8 | 0.15-0.40 | 0.10 | 0.40-0.8 | | | 0.20 | | | | | | | | | | | | 0.05 | 0.15 | Rem. |
| | 0.35 | 0.10 | | 1.1-1.4 | 0.15-0.35 | | 0.10 | | | | | | | | | | | | 0.05 | 0.15 | Rem. |
| 0.6-1.2 | 0.30 | 0.50-1.0 | 0.10 | 0.7-1.1 | 0.20-0.30 | | 0.55-0.9 | 0.10 | | | | | | | | | | | 0.05 | 0.15 | Rem. |
| 0.7-1.3 | 0.50 | 0.50-1.1 | 0.40-1.0 | 0.6-1.2 | 0.25 | | 0.10-0.7 | | | | | | | | | | | 0.20 Zr+Ti | 0.05 | 0.15 | Rem. |
| 0.7-1.3 | 0.20 | 0.7-1.1 | 0.40-0.7 | 0.6-1.2 | 0.25 | | 0.10-0.7 | | | | | | | | | | | | 0.05 | 0.15 | Rem. |
| 0.30-0.6 | 0.10-0.30 | 0.10 | 0.10 | 0.35-0.6 | 0.05 | | 0.15 | 0.10 | | | | | | | | | | | 0.05 | 0.15 | Rem. |
| 0.30-0.6 | 0.15 | 0.20 | 0.05 | 0.35-0.6 | 0.05 | | 0.05 | | | | | | | | | | | | 0.05 | 0.15 | Rem. |
| 0.40-0.6 | 0.15-0.40 | 0.10 | 0.03 | 0.45-0.7 | 0.03 | | 0.05 | 0.10 | | | | | | | | 0.10-0.25 | 0.05 | | 0.05 | 0.15 | Rem. |
| 0.35-0.8 | 0.10-0.30 | 0.15 | 0.02-0.15 | 0.25- | 0.05 | | 0.10 | 0.10 | | | | | | | | | | | 0.05 | 0.15 | Rem. |
| 0.30-0.7 | 0.15 | 0.20 | 0.20 | 0.20-0.6 | 0.05 | | 0.05 | 0.10 | | | | | | | | | | | 0.05 | 0.15 | Rem. |
| 0.20-0.7 | 0.20 | 0.10 | 0.10 | 0.20- | 0.03 | | 0.04 | 0.10 | | | | | | | | | | | 0.05 | 0.15 | Rem. |
| 0.30-0.7 | 0.10-0.30 | 0.05-0.20 | 0.20 | 0.20-0.6 | 0.05 | | 0.15 | 0.10 | | | | | | | | | | | 0.05 | 0.15 | Rem. |
| 0.40-0.8 | 0.15-0.30 | 0.10 | 0.03-0.20 | 0.30-0.6 | 0.05 | 0.05 | 0.10 | 0.10 | | | | 0.05 | | | | 0.05 | | | 0.05 | 0.15 | Rem. |
| 0.40-0.8 | 0.7 | 0.15-0.40 | 0.15 | 0.8-1.2 | 0.04-0.35 | | 0.25 | 0.15 | | | | | | | | | | | 0.05 | 0.15 | Rem. |
| 0.40-0.8 | 0.7 | 0.15-0.40 | 0.15 | 0.8-1.2 | 0.04-0.35 | | 0.25 | 0.15 | | | | | | 0.003 | | | | | 0.05 | 0.15 | Rem. |
| 0.40-0.7 | 0.40 | 0.15-0.40 | 0.20-0.35 | 0.7-1.0 | 0.10 | | 0.20 | 0.10 | | | | | | | | | | | 0.05 | 0.15 | Rem. |
| 0.6-0.9 | 0.40 | 0.20-0.50 | 0.10-0.20 | 1.0-1.4 | 0.10-0.30 | | 0.25 | 0.15 | | | | | | | | | | | 0.05 | 0.15 | Rem. |
| 0.40-0.8 | 0.50 | 0.20 | 0.10 | 0.7-1.1 | 0.10 | | 0.25 | 0.10 | | | | | | | | | | | 0.05 | 0.15 | Rem. |
| 0.40-0.8 | 0.7 | 0.15-0.40 | 0.15 | 0.8-1.2 | 0.04-0.14 | | 0.25 | 0.15 | | | 0.40-0.7 | | | 0.40-0.7 | | | | | 0.05 | 0.15 | Rem. |
| 0.40-0.8 | 0.7 | 0.15-0.40 | 0.15 | 0.8-1.2 | 0.04-0.14 | | 0.25 | 0.10 | | | 0.40-0.9 | | | | 0.40-1.0 | | | | 0.05 | 0.15 | Rem. |
| 0.20-0.6 | 0.35 | 0.10 | 0.10 | 0.45-0.9 | 0.10 | | 0.10 | 0.10 | | | | | | | | | | | 0.05 | 0.15 | Rem. |
| 0.30-0.6 | 0.15-0.35 | 0.10 | 0.15 | 0.6-0.9 | 0.05 | | 0.15 | 0.10 | | | | | | | | | | | 0.05 | 0.15 | Rem. |
| 0.20-0.6 | 0.15 | 0.20 | 0.05 | 0.45-0.9 | | | 0.05 | | | | | | | | | | | | 0.05 | 0.15 | Rem. |
| 0.20-0.6 | 0.15 | 0.25 | 0.05 | 0.30-0.9 | | | 0.05 | | | | | | | | | | | | 0.05 | 0.15 | Rem. |
| 0.20-0.6 | 0.08 | 0.04-0.16 | 0.03 | 0.45-0.9 | | | 0.03 | | | | | | | | | 0.05 | | | 0.03 | 0.10 | Rem. |
| 0.40-0.6 | 0.25 | 0.15-0.25 | 0.05 | 0.35-0.7 | 0.10 | | 0.10 | 0.10 | | | | | | | | | | | 0.05 | 0.15 | Rem. |
| 0.40-0.8 | 0.7 | 0.15-0.40 | 0.15 | 0.8-1.2 | 0.05-0.14 | | 0.25 | 0.15 | | | 0.50-0.7 | | | 0.20-0.40 | | | | | 0.05 | 0.15 | Rem. |
| 0.40-0.8 | 0.7 | 0.15-0.40 | 0.15 | 0.8-1.2 | 0.04-0.14 | | 0.25 | 0.15 | | | 0.40-0.8 | | | 0.20-0.40 | | | | | 0.05 | 0.15 | Rem. |
| 0.40-0.8 | 0.7 | 0.15-0.40 | 0.15 | 0.8-1.2 | 0.15 | | 0.25 | 0.10 | | | 0.50-1.5 | | | 0.05 | | | 0.15 | | 0.05 | 0.15 | Rem. |
| 0.9-1.8 | 0.50 | 0.7-1.2 | 0.6-1.1 | 0.8-1.4 | 0.40 | | 0.25 | 0.20 | | | | | | | | | | | 0.05 | 0.15 | Rem. |
| 0.6-1.4 | 0.50 | 0.10 | 0.40-1.0 | 0.6-1.2 | 0.30 | 0.05 | 0.30 | 0.20 | | | 0.6-1.1 | 0.03 | | 0.20-0.40 | | 0.05 | | | 0.05 | 0.15 | Rem. |
| 0.6-1.2 | 0.40 | 0.55-1.0 | 0.05 | 1.2-1.6 | 0.05-0.30 | | 0.05 | 0.10 | | | | | | | | 0.10-0.30 | | 0.05 Sr | 0.05 | 0.15 | Rem. |
| 1.0-1.7 | 0.50 | 0.15-0.40 | 0.40-1.0 | 0.50-1.2 | 0.10 | | 0.25 | 0.15 | | | | | | | | | | | 0.05 | 0.15 | Rem. |
| 0.7-1.1 | 0.50 | 0.10 | 0.10-0.45 | 0.6-1.0 | 0.10 | | 0.20 | 0.15 | | | | | | | | | | | 0.05 | 0.15 | Rem. |

FIG. 15H

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 0.8-1.2 | 0.45 | 0.10 | 0.15 | 0.6-1.0 | 0.10 | | 0.20 | 0.10 | | | | | | | | | | | 0.05 | 0.15 | Rem. |
| 0.7-1.1 | 0.15-0.50 | 0.25 | 0.40 | 0.6-1.0 | 0.15 | | 0.30 | 0.25 | | | | | | | | 0.10 | | | 0.05 | 0.15 | Rem. |
| 0.7-1.3 | 0.50 | 0.10 | 0.40-1.0 | 0.6-1.2 | 0.25 | | 0.20 | 0.10 | | | | | | | | | | | 0.05 | 0.15 | Rem. |
| 0.7-1.3 | 0.50 | 0.10 | 0.40-1.0 | 0.6-1.2 | 0.25 | | 0.20 | 0.10 | | | | | | 0.003 | | | | | 0.05 | 0.15 | Rem. |
| 0.9-1.3 | 0.50 | 0.10 | 0.50-1.0 | 0.7-1.2 | 0.25 | | 0.20 | 0.10 | | | | | | | | | 0.05-0.20 | | 0.05 | 0.15 | Rem. |
| 0.40-0.8 | 0.7 | 0.15-0.40 | 0.15 | 0.8-1.2 | 0.15 | | 0.25 | 0.15 | | | | | | | | | | 0.05-0.50 O | 0.05 | 0.15 | Rem. |
| 0.40-0.8 | 0.30 | 0.7-1.0 | 0.15 | 0.8-1.2 | 0.15 | | 0.25 | 0.15 | | | | | | | | | | 0.05-0.50 O | 0.05 | 0.15 | Rem. |
| 0.30 | 0.35 | 0.20 | 0.30 | 0.50-1.0 | 0.20 | | 5.0-6.5 | 0.20 | | | | | | | | | 0.05-0.25 | | 0.05 | 0.15 | Rem. |
| 0.25 | 0.35 | 0.05 | 0.20-0.7 | 1.0-2.0 | 0.05 | | 3.8-4.6 | 0.05 | | | | | | | | | 0.10-0.20 | | 0.05 | 0.15 | Rem. |
| 0.30 | 0.35 | 0.20 | 0.20-0.7 | 1.0-2.0 | 0.30 | | 4.0-5.0 | 0.20 | | | | | | | | 0.10 | 0.25 | | 0.05 | 0.15 | Rem. |
| 0.35 | 0.40 | 0.10 | 0.20-0.7 | 1.0-1.8 | 0.06-0.20 | | 4.0-5.0 | 0.01 | | | | | | | | | 0.08-0.20 | | 0.05 | 0.15 | Rem. |
| 0.10 | 0.10 | 0.05 | 0.05 | 0.7-1.4 | | | 4.5-5.5 | 0.05 | | | | | | | | | 0.12-0.25 | | 0.05 | 0.15 | Rem. |
| 0.20 | 0.30 | 0.05 | 0.05 | 0.7-1.5 | 0.04 | | 4.8-5.8 | 0.03 | | | | 0.03 | | | | | 0.15-0.25 | | 0.05 | 0.15 | Rem. |
| 0.20 | 0.20 | 0.6-1.3 | 0.10 | 2.1-2.9 | 0.10-0.25 | | 5.5-6.5 | 0.20 | 0.25-0.40 | | | | | | | | | | 0.05 | 0.15 | Rem. |
| 0.12 | 0.15 | 1.5-2.0 | 0.10 | 2.1-2.6 | 0.05 | 0.05 | 5.7-6.7 | 0.06 | | | | | | | | | 0.10-0.16 | | 0.05 | 0.15 | Rem. |
| 0.15 | 0.25 | 0.8-1.2 | 0.08-0.15 | 1.8-2.2 | 0.04 | | 5.8-6.5 | 0.02 | | | | | | | | | 0.10-0.18 | | 0.05 | 0.15 | Rem. |
| 0.50 | 0.50 | 0.30-0.7 | 0.30-0.7 | 2.2-3.2 | | 0.10 | 5.2-6.2 | | | | | | | | | | | 0.20 Zr+Ti | 0.05 | 0.15 | Rem. |
| 0.20 | 0.30 | 0.06-0.15 | 0.10 | 1.3-2.1 | 0.15 | | 4.6-5.2 | 0.10 | | | | | | | | | 0.10-0.20 | | 0.05 | 0.15 | Rem. |
| 0.10 | 0.12 | 0.45-1.0 | 0.03 | 0.8-1.4 | | | 4.0-5.0 | 0.03 | | | | | | | | 0.05 | | | 0.03 | 0.10 | Rem. |
| 0.15 | 0.30 | 0.50-1.1 | 0.05 | 0.8-1.4 | | | 4.2-5.2 | 0.05 | | | | 0.03 | | | | 0.05 | | | 0.05 | 0.15 | Rem. |
| 0.35 | 0.45 | 0.20 | 0.05-0.50 | 2.0-3.0 | 0.35 | 0.10 | 4.0-5.2 | 0.15 | | | | | | | | | 0.10-0.25 | 0.15 min Mn+Cr | 0.05 | 0.15 | Rem. |
| 0.35 | 0.45 | 0.20 | 0.15-0.50 | 0.7-1.5 | 0.20 | 0.10 | 4.5-5.5 | 0.15 | | | | | | | | | 0.10-0.25 | | 0.05 | 0.15 | Rem. |
| 0.35 | 0.45 | 0.20 | 0.15-0.50 | 1.5-2.5 | 0.20 | 0.10 | 3.5-4.5 | 0.15 | | | | | | | | | 0.10-0.25 | | 0.05 | 0.15 | Rem. |
| 0.30 | 0.40 | 0.10 | 0.10-0.6 | 1.5-2.5 | 0.05-0.35 | | 3.0-5.0 | 0.10 | | | | | | | | | | | 0.05 | 0.15 | Rem. |
| 0.35 | 0.40 | 0.20 | 0.05-0.50 | 1.0-1.4 | 0.10-0.35 | | 4.0-5.0 | | | | | | | | | | 0.08-0.20 | 0.08-0.25 Zr+Ti | 0.05 | 0.15 | Rem. |
| 0.25 | 0.40 | 0.25 | 0.10 | 1.2-1.8 | 0.05 | | 5.0-6.0 | 0.10 | | | | | | | | | 0.08-0.18 | | 0.05 | 0.15 | Rem. |
| 0.50 | 0.50 | 0.50-1.0 | 0.10-0.40 | 2.6-3.7 | 0.10-0.30 | | 4.3-5.2 | | | | | | | | | | | 0.20 Zr+Ti | 0.05 | 0.15 | Rem. |
| 0.25 | 0.35 | 0.50-1.0 | 0.10 | 2.6-3.7 | 0.10 | | 4.3-5.2 | 0.15 | | | | | | | | | 0.10-0.25 | | 0.05 | 0.15 | Rem. |
| 0.50 | 0.50 | 0.50-1.0 | 0.10-0.6 | 2.0-3.0 | 0.05-0.35 | | 4.0-6.0 | 0.10 | | | | | | | | | | | 0.05 | 0.15 | Rem. |
| 0.30 | 0.40 | 0.10 | 0.10-0.6 | 0.50-1.0 | 0.05-0.35 | | 3.0-5.0 | 0.10 | | | | | | | | | | | 0.05 | 0.15 | Rem. |
| 0.30 | 0.40 | 0.10 | 0.10-0.6 | 0.8-1.5 | 0.05-0.35 | | 3.0-5.0 | 0.10 | | | | | | | | | | | 0.05 | 0.15 | Rem. |
| 0.08 | 0.12 | 0.6-0.9 | 0.05-0.20 | 1.5-1.9 | | | 4.6-5.2 | 0.05 | | | | | | | | | 0.09-0.14 | | 0.03 | 0.10 | Rem. |
| 0.35 | 0.50 | 0.10-0.30 | 0.15-0.6 | 1.5-2.3 | 0.20 | | 4.5-5.2 | 0.05 | | | | | | | | | | 0.08-0.25 Zr+Ti | 0.05 | 0.15 | Rem. |
| 0.10 | 0.12 | 0.50-0.9 | 0.03 | 1.3-2.0 | | | 4.2-5.2 | 0.05 | | | | | | | | 0.05 | | | 0.03 | 0.10 | Rem. |
| 0.15 | 0.30 | 0.50-0.9 | 0.10 | 1.3-2.0 | 0.10 | | 4.2-5.2 | 0.05 | | | | 0.03 | | | | 0.05 | | | 0.05 | 0.15 | Rem. |
| 0.06 | 0.08 | 0.50-0.9 | 0.03 | 1.3-2.0 | | | 4.2-5.2 | 0.05 | | | | | | | | 0.05 | | | 0.03 | 0.10 | Rem. |
| 0.20 | 0.30 | 0.20-0.40 | 0.05 | 1.0-1.5 | 0.04 | | 4.8-5.9 | 0.03 | | | | 0.03 | | | | | 0.03 | | 0.05 | 0.15 | Rem. |
| 0.30 | 0.8-1.4 | 0.10 | 0.10-0.40 | 0.10 | | | 0.8-1.8 | | | | | | | | | | | | 0.05 | 0.15 | Rem. |
| 0.10 | 0.12 | 1.7-2.3 | 0.05 | 1.5-2.5 | 0.15-0.25 | | 5.5-6.5 | 0.10 | | | 0.01 | | | 0.01 | | | | | 0.05 | 0.15 | Rem. |
| 0.15 | 0.30 | 0.7-1.3 | 0.10 | 1.3-2.2 | 0.20 | | 4.6-5.6 | 0.10 | | | | 0.03 | | | | 0.05 | 0.08-0.15 | | 0.05 | 0.15 | Rem. |
| 0.10 | 0.12 | 0.8-1.2 | 0.25 | 2.0-3.0 | 0.20 | | 11.0-12.0 | | | | | | | | | | 0.08-0.30 | | 0.05 | 0.15 | Rem. |
| 0.15 | 0.25 | 0.05-0.30 | 0.10 | 2.5-3.5 | 0.05 | | 4.3-5.5 | 0.02 | | | | | | | | | 0.08-0.20 | | 0.05 | 0.15 | Rem. |
| 0.15 | 0.25 | 0.05-0.30 | 0.10 | 2.5-3.5 | 0.05 | | 4.3-5.5 | 0.02 | | | | | | | | | 0.04-0.20 | | 0.05 | 0.15 | Rem. |
| 0.12 | 0.15 | 1.9-2.5 | 0.05 | 1.8-2.5 | 0.08-0.13 | | 8.4-9.4 | 0.10 | | | | | | | | | 0.10-0.20 | | 0.05 | 0.15 | Rem. |
| 0.12 | 0.15 | 1.9-2.5 | 0.05 | 1.8-2.5 | 0.05 | | 8.4-9.4 | 0.10 | | | | | | | | | 0.10-0.20 | | 0.05 | 0.15 | Rem. |
| 0.10 | 0.10 | 0.6-1.1 | 0.50 | 1.3-2.1 | 0.04 | | 7.8-9.0 | 0.10 | | | | | | | | | 0.06-0.25 | | 0.05 | 0.15 | Rem. |
| 0.30 | 0.40 | 0.10 | 0.10-0.40 | 2.3-3.3 | 0.15-0.25 | | 3.5-4.5 | 0.10 | | | | | | | | | | | 0.05 | 0.15 | Rem. |

FIG. 15I

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 0.10 | 0.13 | 1.5-2.3 | 0.04 | 1.7-2.4 | 0.04 | | 5.7-6.7 | 0.06 | | | | | | | | | 0.05-0.12 | | 0.05 | 0.15 | Rem. |
| 0.10 | 0.13 | 1.3-2.3 | 0.04 | 1.5-2.4 | 0.04 | | 6.2-7.0 | 0.06 | | | | | | | | | 0.05-0.12 | | 0.05 | 0.15 | Rem. |
| 0.15 | 0.25 | 0.40-0.9 | 0.04 | 1.5-2.3 | 0.04 | | 5.7-6.7 | 0.06 | | | | | | | | | 0.05-0.12 | | 0.05 | 0.15 | Rem. |
| 0.20 | 0.20 | 1.3-1.9 | 0.20-0.40 | 2.0-2.8 | 0.05 | | 6.5-7.9 | | | | | | | | | | 0.11-0.20 | 0.18-.050 Sc | 0.05 | 0.15 | Rem. |
| 0.20 | 0.40 | 0.25 | 0.30 | 1.0-1.6 | 0.20 | | 6.6-7.6 | 0.06 | | | | | | | | | 0.10-0.18 | | 0.05 | 0.15 | Rem. |
| 0.20 | 0.40 | 0.35 | 0.30 | 0.8-1.6 | 0.20 | | 6.1-7.3 | 0.06 | | | | | | | | | 0.10-0.25 | | 0.05 | 0.15 | Rem. |
| 0.12 | 0.15 | 0.04 | 0.04 | 1.3-1.8 | 0.05 | | 7.0-8.0 | 0.08 | 0.25-0.50 | | | | | | | | 0.07-0.13 | | 0.05 | 0.15 | Rem. |
| 0.25 | 0.35 | 1.2-1.9 | 0.20 | 2.0-2.9 | 0.10-0.22 | | 7.2-8.2 | 0.10 | | | | | | | | | | | 0.05 | 0.15 | Rem. |
| 0.40 | 0.50 | 1.2-1.9 | 0.50 | 2.1-3.1 | 0.05-0.25 | | 7.2-8.4 | | | | | | | | | | | 0.25 Zr+Ti | 0.05 | 0.15 | Rem. |
| 0.15 | 0.20 | 1.2-1.9 | 0.20 | 2.0-2.9 | 0.10-0.22 | | 7.2-8.2 | 0.10 | | | | | | | | | | | 0.05 | 0.15 | Rem. |
| 0.10 | 0.12 | 1.3-1.9 | 0.10 | 2.0-2.4 | 0.12-0.18 | | 7.5-8.2 | 0.06 | | | | | | | | | | | 0.05 | 0.15 | Rem. |
| 0.12 | 0.15 | 1.4-2.1 | 0.20 | 1.8-2.7 | 0.10-0.22 | | 7.5-8.7 | | | | | | | | | | | 0.25 Zr+Ti | 0.05 | 0.15 | Rem. |
| 0.12 | 0.15 | 1.4-2.1 | 0.20 | 1.8-2.7 | | | 7.5-8.7 | | | | | | | | | | | 0.25 Zr+Ti | 0.05 | 0.15 | Rem. |
| 0.12 | 0.15 | 2.0-2.6 | 0.10 | 1.9-2.6 | 0.04 | | 5.7-6.7 | 0.06 | | | | | | | | | 0.08-0.15 | | 0.05 | 0.15 | Rem. |
| 0.12 | 0.15 | 1.7-2.4 | 0.04 | 1.7-2.6 | 0.04 | 0.03 | 5.7-6.9 | 0.06 | | | | | | | | | 0.05-0.12 | | 0.05 | 0.15 | Rem. |
| 0.12 | 0.15 | 1.9-2.5 | 0.10 | 2.0-2.7 | 0.04 | | 5.9-6.9 | 0.06 | | | | | | | | | 0.08-0.15 | | 0.05 | 0.15 | Rem. |
| 0.10 | 0.15 | 2.0-2.6 | 0.05 | 1.8-2.3 | 0.04 | | 7.6-8.4 | 0.06 | | | | | | | | | 0.08-0.25 | | 0.05 | 0.15 | Rem. |
| 0.25 | 0.25 | 2.0-2.6 | 0.10 | 1.8-2.3 | 0.05 | | 7.6-8.4 | 0.10 | | | | | | | | | 0.08-0.15 | | 0.05 | 0.15 | Rem. |
| 0.06 | 0.09 | 2.0-2.6 | 0.05 | 1.8-2.3 | 0.04 | | 7.6-8.4 | 0.06 | | | | | | | | | 0.08-0.15 | | 0.05 | 0.15 | Rem. |
| 0.10 | 0.12 | 1.2-1.9 | 0.20 | 1.5-2.3 | | | 8.5-9.7 | 0.08 | | | | | | | | | 0.05-0.15 | | 0.05 | 0.15 | Rem. |
| 0.15 | 0.20 | 1.8-2.6 | 0.20 | 1.3-2.1 | 0.15-0.25 | | 6.1-7.5 | 0.05 | | | | | | 0.003 | | | 0.05 | | 0.05 | 0.15 | Rem. |
| 0.12 | 0.15 | 1.8-2.4 | | 1.9-2.9 | 0.06-0.25 | | 6.8-8.0 | | | | | | | | | | 0.10-0.50 | 0.10-0.40 Co, 0.05-0.30 O | 0.05 | 0.15 | Rem. |
| 0.06 | 0.08 | 1.9-2.3 | 0.04 | 1.5-1.8 | 0.04 | | 7.1-8.3 | 0.06 | | | | | | | | | 0.05-0.15 | | 0.05 | 0.15 | Rem. |
| 0.12 | 0.15 | 1.6-2.4 | 0.10 | 2.2-3.0 | 0.05 | | 7.3-8.3 | 0.10 | | | | | | | | | 0.05-0.15 | | 0.05 | 0.15 | Rem. |
| 0.10 | 0.12 | 1.6-2.4 | 0.05 | 2.0-2.8 | 0.04 | | 7.8-8.8 | 0.10 | | | | | | | | | 0.05-0.15 | | 0.05 | 0.15 | Rem. |
| | | 0.10 | 0.10 | 0.10 | | | 0.8-1.3 | | | | | | | | | | | 0.7 Si+Fe | 0.05 | 0.15 | Rem. |
| 0.40 | 0.50 | 1.2-2.0 | 0.30 | 2.1-2.9 | 0.18-0.28 | | 5.1-6.1 | 0.20 | | | | | | | | | | | 0.05 | 0.15 | Rem. |
| 0.15 | 0.20 | 1.2-2.0 | 0.10 | 2.1-2.9 | 0.18-0.28 | | 5.1-6.1 | 0.10 | | | | | | | | | | | 0.05 | 0.15 | Rem. |
| 0.10 | 0.12 | 1.2-1.9 | 0.06 | 1.9-2.6 | 0.18-0.25 | | 5.2-6.2 | 0.06 | | | | | | | | | | | 0.05 | 0.15 | Rem. |

FIG. 15J

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 0.40 | 0.6 | 0.30-1.0 | 0.30-0.8 | 1.2-2.0 | | | 7.0-8.0 | 0.20 | | | | | | | | | | | 0.05 | 0.15 | Rem. |
| 0.40 | 0.50 | 1.6-2.4 | 0.30 | 2.4-3.1 | 0.18-0.28 | | 6.3-7.3 | 0.20 | | | | | | | | | | | 0.05 | 0.15 | Rem. |
| 0.15 | 0.20 | 1.6-2.2 | 0.02 | 2.5-3.2 | 0.17-0.25 | | 6.6-7.4 | 0.03 | | | | 0.03 | | | | 0.05 | | | 0.03 | 0.10 | Rem. |
| 0.12 | 0.15 | 1.3-2.1 | 0.25 | 2.3-3.2 | 0.05 | | 6.4-7.4 | 0.05 | | | | | | | | | 0.05-0.25 | | 0.05 | 0.15 | Rem. |
| 0.12 | 0.15 | 1.2-1.8 | 0.25 | 1.8-2.2 | 0.04 | | 6.9-7.5 | 0.06 | | | | | | | | | 0.06-0.15 | | 0.05 | 0.15 | Rem. |
| 0.08 | 0.10 | 1.2-1.9 | 0.15 | 1.7-2.2 | 0.04 | | 6.7-7.9 | 0.06 | | | | | | | | | 0.08-0.18 | | 0.05 | 0.15 | Rem. |
| 0.08 | 0.08 | 1.3-2.0 | 0.04 | 1.2-1.8 | 0.04 | | 7.0-8.0 | 0.06 | | | | | | | | | 0.08-0.15 | | 0.05 | 0.15 | Rem. |
| 0.25 | 0.25 | 1.3-2.0 | 0.10 | 1.2-1.8 | 0.10 | | 7.0-8.2 | 0.06 | | | | | | | | | 0.08-0.15 | | 0.05 | 0.15 | Rem. |
| 0.12 | 0.15 | 0.6-1.3 | | 2.0-3.0 | | | 7.3-8.7 | | | | | | | | | | | 1.0-1.9 Co, 0.20-0.50 O | 0.05 | 0.15 | Rem. |
| 0.12 | 0.15 | 1.1-1.9 | | 2.0-3.0 | | 0.04-0.16 | 8.3-9.7 | | | | | | | | | | 0.08-0.20 | 0.05-0.50 O | 0.05 | 0.15 | Rem. |
| 0.10 | 0.12 | 2.0-2.8 | 0.05 | 1.4-2.0 | | | 8.6-9.8 | 0.06 | | | | | | | | | 0.08-0.15 | | 0.05 | 0.15 | Rem. |
| 0.12 | 0.15 | 1.4-2.1 | 0.04 | 1.6-2.3 | 0.04 | | 7.4-8.4 | 0.06 | | | | | | | | | 0.05-0.15 | | 0.05 | 0.15 | Rem. |
| 0.10 | 0.12 | 1.4-2.1 | 0.04 | 1.6-2.3 | 0.04 | | 7.4-8.4 | 0.06 | | | | | | | | | 0.05-0.15 | | 0.05 | 0.15 | Rem. |

FIG. 15K

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 0.30 | 0.30 | 4.0-5.0 | 0.30-0.8 | 0.02 | | | 0.10 | 0.15 | | | | | | | | 0.05-0.20 | 0.10-0.25 | 0.05-0.20 Cd | 0.05 | 0.15 | Rem. |
| 0.40 | 0.40 | 4.0-5.0 | 0.30-0.8 | 0.03 | | | 0.25 | 0.10 | | | | | 0.9-1.7 | | | | | 0.10-0.35 Cd | 0.05 | 0.15 | Rem. |
| 0.15 | 0.20 | 2.8-3.8 | 0.20-0.6 | 1.2-1.8 | | | 0.25 | 0.10 | | | | | | | | | | | 0.05 | 0.15 | Rem. |
| 0.30 | 0.50 | 1.2-1.8 | 0.20 | 0.20-0.50 | | | 0.10 | 0.10 | | | | | | | | | | | 0.05 | 0.15 | Rem. |
| 0.10 | 0.20 | 3.3-4.1 | 0.25 | 1.5-2.2 | | | 0.10 | | | | | | | | | | 0.08-0.25 | 0.005 Be, 0.05-0.50 O | 0.05 | 0.15 | Rem. |
| 0.12 | 0.15 | 2.3-3.0 | 0.25 | 0.25-0.8 | | | 0.25 | 0.10 | 0.25-0.6 | | | | 1.3-1.9 | | | | 0.04-0.18 | | 0.05 | 0.15 | Rem. |
| 1.5-2.5 | 0.8 | 0.20 | 0.10 | 0.05 | | | 0.10 | 0.15 | | | | | | | | | | | 0.05 | 0.15 | Rem. |
| 3.5-4.5 | 0.35 | 0.05-0.15 | 0.03 | 0.05-0.15 | | | 0.15 | 0.02 | | | | | | | | | | 0.8-1.4 Cd | 0.05 | 0.15 | Rem. |
| 6.8-8.2 | 0.8 | 0.25 | 0.10 | 2.0-3.0 | | | 0.20 | | | | | | | | | | | | 0.05 | 0.15 | Rem. |
| 9.5-11.0 | 0.8 | 0.25 | 0.10 | 0.20-1.0 | | | 0.20 | | | | | | | | | | | | 0.05 | 0.15 | Rem. |
| 6.5-7.5 | 0.20 | 0.20 | 0.10 | 0.45-0.7 | | | 0.10 | 0.04-0.20 | | | | | | | | | | 0.04-0.07 Be | 0.05 | 0.15 | Rem. |
| 11.0-13.0 | 0.8 | 1.0-2.0 | 0.5-0.9 | 0.45-1.0 | | | 1.0 | | | | | | | | | | | | | | Rem. |
| 9.3-10.7 | 0.8 | 3.3-4.7 | 0.07 | 0.07 | 0.07 | | 9.3-10.7 | | | | | | | | | | | | 0.05 | 0.15 | Rem. |

FIG. 15L

TABLE 1: UNIALLOY COMPOSITIONS (continued)

| Si | Fe | Cu | Mn | Mg | Cr | Ni | Zn | Ti | Ag | B | Bi | Ga | Li | Pb | Sn | V | Zr | | OTHERS Each | OTHERS Total | Al Minimum |
|---|---|---|---|---|---|---|---|---|---|---|---|---|---|---|---|---|---|---|---|---|---|
| 0.35-0.7 | 0.6 | 0.10 | 0.03 | 0.35-0.7 | 0.03 | | 0.10 | | | | | | | | | | | | 0.03 | 0.10 | Rem. |
| 0.30-0.6 | 0.10-0.30 | 0.10 | 0.20-0.6 | 0.40-0.7 | | | 0.05 | | | | | | | | | | | | 0.05 | 0.15 | Rem. |
| 0.9-1.4 | 0.7 | 0.20 | 0.05-0.25 | 0.6-0.9 | 0.05-0.25 | | 0.25 | 0.15 | | | | | | | | | 0.05-0.20 | | 0.05 | 0.15 | Rem. |
| 0.55-0.7 | 0.15-0.30 | 0.05-0.20 | 0.10 | 0.45-0.6 | 0.10 | | 0.05 | 0.05 | | | | | | | | | | | 0.05 | 0.15 | Rem. |
| 0.40-0.8 | 0.7 | 0.15-0.40 | 0.15 | 0.8-1.2 | 0.04-0.35 | | 0.25 | 0.15 | | | | | | | 0.05-0.50 | | | 0.05-0.50 In | 0.05 | 0.15 | Rem. |
| 0.6-1.2 | 1.0 | 0.15 | 0.20 | 0.45-0.8 | | | 0.25 | | | | | | | | | | | | 0.05 | 0.15 | Rem. |
| 0.40-0.8 | 0.7 | 0.15-0.40 | 0.15 | 0.8-1.2 | 0.04-0.14 | | 0.25 | 0.15 | | | | | | | | | | | 0.05 | 0.15 | Rem. |
| 0.9-1.8 | 0.7 | 0.9-2.0 | 0.40-1.2 | 0.7-1.5 | 0.20 | | 0.25 | 0.20 | | | | | | | | | | | 0.05 | 0.15 | Rem. |
| 1.1-1.9 | 0.50 | 0.15-0.40 | 0.40-1.0 | 0.8-1.4 | 0.10 | | 0.25 | 0.15 | | | | | | | | | | | 0.05 | 0.15 | Rem. |
| 0.40-0.8 | 0.7 | 0.30-0.9 | 0.15 | 0.8-1.2 | 0.15 | | 0.25 | 0.15 | | | | | | | | | | 0.05-0.7 O | 0.05 | 0.15 | Rem. |
| 0.35 | 0.40 | 1.6-2.6 | 0.20 | 2.6-3.4 | 0.18-0.35 | | 6.8-8.0 | 0.20 | | | | | | | | | | | 0.05 | 0.15 | Rem. |
| 0.20 | 0.40 | 0.50-1.0 | 0.05-0.30 | 2.0-3.0 | 0.10-0.30 | | 3.0-4.0 | 0.15 | | | | | | | | | | | 0.05 | 0.15 | Rem. |
| | | 0.10 | 0.50 | 1.7-2.8 | 0.30 | | 3.7-4.8 | 0.15 | | | | | | | | | | 0.35 Si+Fe | 0.05 | 0.15 | Rem. |
| | | 0.25 | 0.40 | 1.4-2.2 | 0.05-0.25 | | 6.0-7.0 | 0.01-0.06 | | | | | | | | | 0.05-0.25 | 0.40 Si+Fe | 0.05 | 0.15 | Rem. |
| 0.10 | 0.10 | 0.05 | 0.05 | 0.7-1.4 | 0.12-0.25 | | 4.5-5.5 | 0.05 | | | | | | | | | | | 0.05 | 0.10 | Rem. |
| 0.15 | 0.20 | 0.05 | 0.10-0.30 | 1.0-1.6 | 0.05-0.20 | | 4.0-5.5 | 0.05 | | | | | | | | | | | 0.05 | 0.15 | Rem. |
| 0.6 | 0.7 | 0.10 | 1.0-1.5 | | | | 1.5-2.0 | | | | | | | | | | | | 0.05 | 0.15 | Rem. |
| 0.25 | 0.40 | 0.10-0.30 | 0.10-0.40 | 0.7-1.1 | | | 3.5-4.5 | 0.10 | | | | | | | | | 0.05-0.30 | | 0.05 | 0.15 | Rem. |
| 0.20 | 0.35 | 0.10 | 0.10-0.35 | 3.0-4.0 | 0.05-0.25 | | 4.0-5.0 | 0.10 | | | | | | | | | | | 0.05 | 0.15 | Rem. |
| 0.35 | 0.45 | 0.15 | 0.10-0.45 | 1.7-2.5 | 0.05-0.25 | | 3.0-4.0 | 0.15 | | | | | | | | | | | 0.05 | 0.15 | Rem. |
| 0.15 | 0.25 | 0.05 | | | | | 1.3-1.8 | | | | | | | | | | | | 0.05 | 0.15 | Rem. |
| 0.50 | 0.7 | 0.8-1.7 | | 1.7-2.3 | 0.18-0.35 | | 3.7-4.3 | 0.10 | | | | | | | | | | | 0.05 | 0.15 | Rem. |
| 030 | 0.40 | 0.40-0.8 | 0.10-0.30 | 2.9-3.7 | 0.10-0.25 | | 3.8-4.8 | 0.10 | | | | | | | | | | | 0.05 | 0.15 | Rem. |
| 0.30 | 0.40 | 0.50-1.5 | 0.10-0.7 | 1.5-3.0 | 0.12 | | 5.0-7.0 | 0.20 | | | | | | | | | | | 0.05 | 0.15 | Rem. |
| 0.12 | 0.15 | 1.1-1.8 | | 2.0-3.0 | | | 5.8-7.1 | | | | | | | | | | | 0.20-0.6 Co, 0.20-0.50 O | 0.05 | 0.15 | Rem. |

FIG. 15M

BEVERAGE CONTAINER BODY, CAN END, AND MATERIAL THEREFOR

CROSS-REFERENCE TO RELATED APPLICATIONS

This Application claims the benefit of U.S. Provisional Patent Application No. 63/203,584, which was filed on Jul. 27, 2021, and hereby incorporates same by reference as if fully set forth herein.

FEDERALLY SPONSORED RESEARCH OR DEVELOPMENT

N/A

TECHNICAL FIELD

The invention relates to beverage containers; more particularly, the invention relates to beverage containers produced from an aluminum alloy.

BACKGROUND

Conventional two-piece beverage containers generally include a can body featuring a closed bottom end separated from an opposing open end by a generally cylindrical side wall. The closed bottom is integrally formed with the side wall.

A can end, or lid, is attached to the open end of the can body. Typical, can ends utilize a stay-on tab (SOT) ecology design, where a deflectable tab is attached to a center panel of the can end. The center panel includes a frangible score. The tab is deflected against a tear panel defined by the frangible score and a non-frangible hinge segment. The frangible score is fractured by a force exerted by a nose portion of the tab against the tear panel. This forces the tear panel into the containment space of the can body, but the tear panel stays attached to the center panel through the non-frangible hinge segment.

Each of these beverage containers are typically produced from a plurality of metal alloys, conventionally sheets of aluminum alloys supplied as coils. Due to design differences and different forces acting on each of the component parts, the tabs, can ends, and can bodies are often produced from two or more different aluminum alloys. Generally, can bodies are produced from a 3XXX aluminum alloy. Can ends and tabs are produced from a 5XXX aluminum alloy.

Recycled aluminum materials are often used in the manufacture of the aluminum alloys used to produce beverage containers. These recycled materials are introduced as molten scrap during the aluminum sheet making process. The composition of the melted scrap is dependent upon the alloys in the recycle stream, and to a lesser extent, the coatings and residual materials on the recycled materials.

Referring to FIG. 1, a conventional manufacturing method for an aluminum alloy used to produce container components is illustrated employing a direct chill casting aluminum alloy casting process. According to this process, recycled or scrap metal and virgin materials are melted. The composition of the molten metal is tested and additional alloying elements are added, as necessary. The molten metal is cast into slabs and solidified. The slabs are reheated and hot rolled at elevated temperature into a thick sheet, which may be coiled. The thick sheet is cold rolled to final thickness and coiled. Subsequently, as shown in this example, the coiled aluminum sheet of final thickness is formed into a can body according to the conventional draw and iron process which is well-known within the can-making industry.

Referring to FIG. 2, a conventional manufacturing method for an aluminum alloy used to beverage container components employing a continuous casting aluminum alloy casting process is illustrated. According to this process, recycled or scrap metal and virgin materials are melted. The composition of the molten metal is tested and additional alloying elements are added, as necessary. The molten metal is cast into slabs and solidified. The slabs are reheated and hot rolled at elevated temperature into a thick sheet, which may be coiled. The thick sheet is cold rolled to final thickness and coiled. Subsequently, as shown in this example, the coiled aluminum sheet of final thickness is formed into a can end according to the conventional shell production in a shell press, a water-based liner is applied and dried on the can end shell, and the can end shell is converted in a conversion press where a tab is staked, or attached, to a center panel of the can end by a rivet. This is an industry standard practice. The coating process may include UV and e-beam curing, as well as laminated materials (plastic (PET) coated).

Referring to FIG. 3, a conventional manufacturing method for an aluminum alloy used to produce container components is illustrated employing twin roll casting aluminum alloy casting process with one or more optional hot rolling steps. According to this process, recycled or scrap metal and virgin materials are melted. The composition of the molten metal is tested and additional alloying elements are added, as necessary. The molten metal is cast into a sheet or strip, typically having a thickness of 6 mm (0.24 inches). The sheet or strip may be optionally hot rolled at elevated temperature into a sheet, then annealed, cold rolled to final thickness, and coiled. Subsequently, the coiled aluminum sheet of final thickness is formed into a container component according to the conventional beverage container component draw and iron processes which are well-known within the can-making industry.

SUMMARY

One aspect of the disclosure is directed to a method of forming a beverage container comprising the steps of:

forming a can body from a metal alloy; and forming a can end from a substantially compositionally identical metal alloy.

This aspect of the disclosure may include one or more of the following features, alone or in any reasonable combination. The method may further comprise the step of heat treating at least one of the metal alloy or the substantially compositionally identical metal alloy. The heat treating step may be performed prior to the forming a can body step and the forming the can end step. The step of heat treating may be performed on the metal alloy. The step of the heat treating may be performed after the step of forming the can body. The step of heat treating may be an age hardening performed between 225° F. and 350° F. The method may further comprise the steps of: casting the metal alloy in a liquid state into one of a solid slab, plate, or sheet; cold rolling a thin metal sheet to reduce a thickness of the thin metal sheet in to a cold rolled metal alloy sheet; coiling the cold rolled metal alloy sheet; and performing a solid solution heat treatment metal alloy prior to forming the can body. The performing the solid solution heat treatment step may be performed one of before the cold rolling, during the cold rolling, or after the cold rolling step. The method may further comprise the steps of: reheating the slab, plate or sheet into a reheated slab, plate of sheet; and hot rolling the reheated slab, plate or sheet to reduce a thickness of the reheated slab, plate, or sheet into the thin metal sheet. The metal alloy and the substantially compositionally identical metal alloy may be selected from the group consisting of a 4XXX, a 6XXX, a 2XXX, and a 7XXX aluminum alloy. The metal alloy and the substantially compositionally identical metal alloy have a composition comprising, in mass %, according to any of compositions of the alloys listed in Table 1.

Another aspect of the disclosure is directed to a beverage container comprising:

- a can body comprising a cylindrical sidewall, a bottom integral with the sidewall, and an open end;
- a can end comprising:
- a curl positioned about a longitudinal axis;
- a circumferential wall extending downwardly from the curl;
- a strengthening member extending radially inwardly from the circumferential wall;
- a center panel extending radially inwardly from the strengthening member comprising a tear panel defined by a frangible score and a non-frangible hinge segment; and
- a tab overlaying the tear panel and attached to the center panel,
- wherein the can body, can end and tab are produced from a substantially compositionally identical metal alloy.

This aspect of the disclosure may include one or more of the following features, alone or in any reasonable combination. The substantially compositionally identical metal alloy comprises at least 65% recycled metallic materials. One of the tab, can body, and can end is produced from a heat treated alloy. The heat treated alloy may undergo an age hardening process at an age hardening temperature between 116° C. and 238° C.+/−3° C. to produce an age hardened alloy. The can end may be produced from the age hardened alloy. The heat treated alloy may undergo a heat treatment at a temperature below a recrystallization temperature of the substantially compositionally identical metal alloy. The metal alloy and the substantially compositionally identical metal alloy may be selected from the group consisting of a 4XXX, a 6XXX, a 2XXX, and a 7XXX aluminum alloy. The substantially compositionally identical metal alloy may comprise, in mass %, any of the compositions listed in Table 1.

Another aspect of the disclosure is directed to a method of forming a beverage container can body comprising the steps of:

- forming a shallow cup from a sheet of a metal alloy;
- reforming the shallow cup into a pre-body having an open end, an elongated cylindrical sidewall, and an integral bottom;
- reforming the pre-body into a can body comprising a circumferential shoulder of reducing diameter, a neck, and a radially outwardly curled flange;
- aging the can body at an aging temperature greater than an ambient temperature for a duration of time.

This aspect of the disclosure may include one or more of the following features, alone or in any reasonable combination. The aging temperature may be between 100° F. and 600° F. The aging temperature may be between 150° F. and 500° F. The aging temperature may be between 225° F. and 350° F. The aging step may be performed after the reforming the pre-body into the can body step. The method may further comprise the step of cleaning the can body after the reforming the pre-body into the can body step. The method may further comprise the step of decorating the can body with a pigmented fluid. The decorating step may be performed after the aging step. The aging step may be performed after the cleaning step.

Other features and advantages of the disclosure will be apparent from the following specification taken in conjunction with the following drawings.

BRIEF DESCRIPTION OF THE DRAWINGS

To understand the present invention, it will now be described by way of example, with reference to the accompanying drawings in which:

FIGS. 15A-15M is a table including possible unialloy compositions according to the present disclosure.

DETAILED DESCRIPTION

Figure 1:
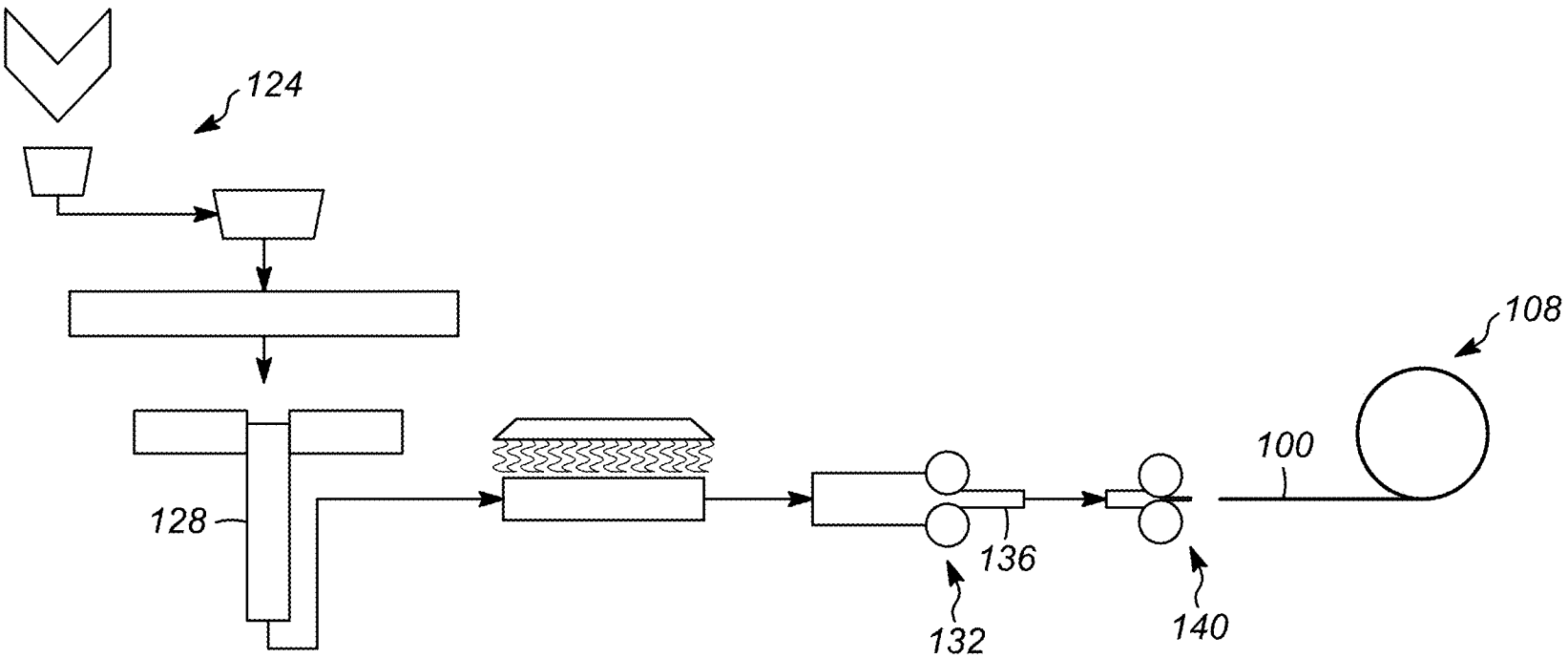
FIG. 1 Prior Art
FIG. 1 is a schematic diagram of a process for manufacturing beverage container component metal alloy stock.
Figure 2:
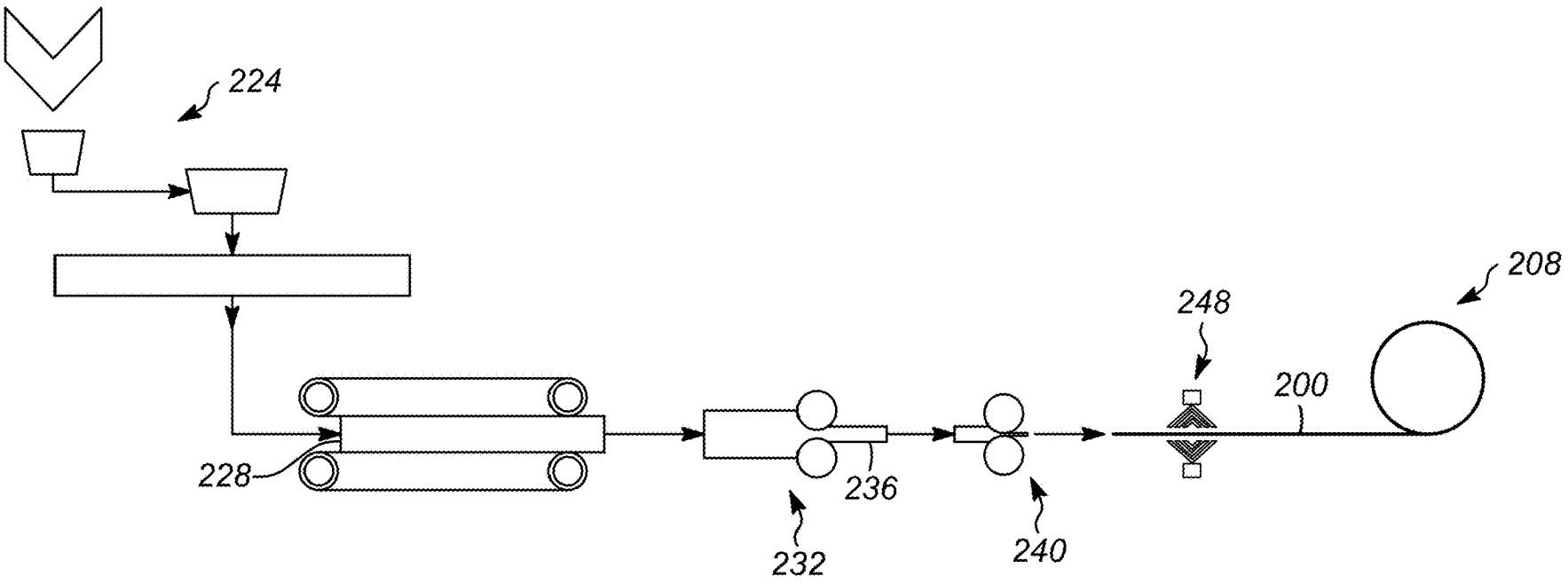
FIG. 2 Prior Art
FIG. 2 is a schematic diagram of a process from manufacturing beverage container component metal alloy stack.
Figure 3:
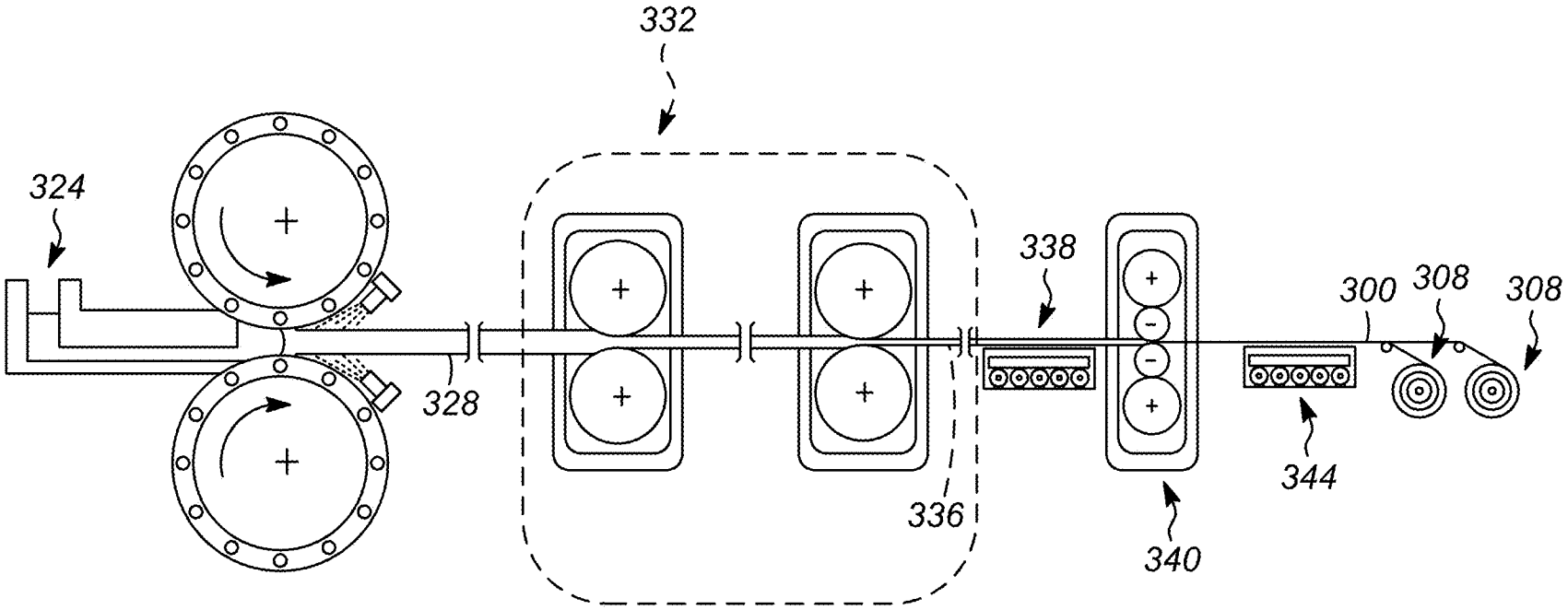
FIG. 3 Prior Art
FIG. 3 is a schematic diagram of a process from manufacturing beverage container component metal alloy stack, optional hot rolling is indicated by dashed lines.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present disclosure describes a beverage container produced from a single aluminum alloy, or at least substantially compositionally identical aluminum alloys. Here, the term "substantially compositionally identical" is intended to encompass alloys falling within the designed composition specification in mass percent, for example, such as those listed in Table 1 (FIGS. 15A-15M).

The present disclosure is primarily aimed at production and exploitation of a unialloy. It is contemplated that the unialloy can be manufactured such that a single metal alloy can be used to produce a beverage container, more specifically the can ends, can bodies, and can end tabs for a beverage container. It is further contemplated that the unialloy is an aluminum alloy. The aluminum alloy is processed differently depending on the end use, for example a can end, a tab, or a can body. It is further contemplated that the teachings set forth in this disclosure may allow use of a recycled aluminum stream that is greater than currently used. Through these teachings, beverage container components can be produced from 50% recycled aluminum material, preferably at least 65% recycled aluminum material, more preferably at least 70% recycled aluminum material, still more preferably 80% recycled aluminum material, still more preferably at least 90% recycled aluminum material, and most preferably a true 100% recycled aluminum material project.

It is further contemplated that beverage container components can be produced from a unialloy stock or sheet having a thickness equal to or less than the thicknesses currently used. For example, a thickness of the unialloy sheet used to produce a can body is between 0.0090 to 0.0970 inches (0.229 mm to 2.5 mm); a thickness of the unialloy sheet used to produce a can end tab is between 0.00809 to 0.0151 inches (0.205 mm to 0.38 mm); a thickness of the unialloy sheet used to produce a can end is between 0.0080 to 0.0142 inches (0.20 mm to 0.36 mm).

More preferably, regarding unialloy sheet thickness of can body stock, thickness is dependent on diameter of the can body open end. The present disclosure contemplates downgauging to produce can bodies from starting sheet thicknesses of 0.0060 to 0.0065 inches for 202-size can bodies, 0.0070 inches for lightweight 204-sized can bodies for non-carbonated contents, 0.0070 inches for lightweight 209-sized can bodies for non-carbonated contents, 0.0075 inches for lightweight 211-sized can bodies for non-carbonated contents, and 0.0100 inches for 300-size can bodies can bodies for non-carbonated contents. For metal drinking cups, the starting thickness of the metal sheet can be 0.0060 inches.

More preferably, regarding unialloy sheet thickness of can end stock. The present disclosure contemplates downgauging to produce can ends from sheet thicknesses of 0.0060 for can ends for non-carbonated, $N_2$-dosed beverages and 0.0070 to 0.0080 inches for can ends for beer and carbonated beverages requiring a minimum buckle strength, wherein the minimum buckle strength is preferably 90 psi buckle (620 kPa).

TABLE 1

Unialloy Sheet Thicknesses

| Beverage Container Component | Min. Sheet Thickness | Max. Sheet Thickness |
|---|---|---|
| Tab | 0.00809 ins. (0.205 mm) | 0.0151 ins. (0.38 mm) |
| Can End | 0.0060 ins. (0.15 mm) | 0.0142 ins. (0.36 mm) |
| Can Body | 0.0060 ins. (0.15 mm) | 0.0970 ins. (2.5 mm) |

It is further contemplated that the teachings set forth herein can be used to design beverage containers produced from thinner aluminum sheet than is now provided.

Can ends and can bodies are typically produced from different metal alloys. Due to differing mechanical property requirements, can ends are commercially produced from a 5XXX aluminum alloy, for example a 5182 aluminum alloy, and can bodies are produced from a 3XXX aluminum, for example a 3104 aluminum alloy. Generally speaking, 3XXX and 5XXX aluminum alloys are non-heat treatable alloys. These alloys attain optimal mechanical properties through cold work operations.

According to the present disclosure, can ends and can bodies are produced from a heat treatable metal alloy. The metal alloy is preferably an aluminum alloy. The aluminum alloy is more preferably selected from the group consisting of a 4XXX series aluminum alloy, a 2XXX series aluminum alloy, a 6XXX series aluminum alloy, and a 7XXX series aluminum alloy. Heat treatment processes as disclosed herein are chosen based on the article manufactured therefrom and the desired mechanical properties to be exhibited by the alloys. The heat treating step(s) may be performed prior to and subsequent to the forming a can body step and subsequent to the forming a can end step It is contemplated that the methods and articles disclosed herein can be, though not necessarily, exploited in existing can-making facilities using current presses and processes. These principles allow for flexibility in producing beverage container components from differing thicknesses of the metal alloy sheets.

Figure 4:
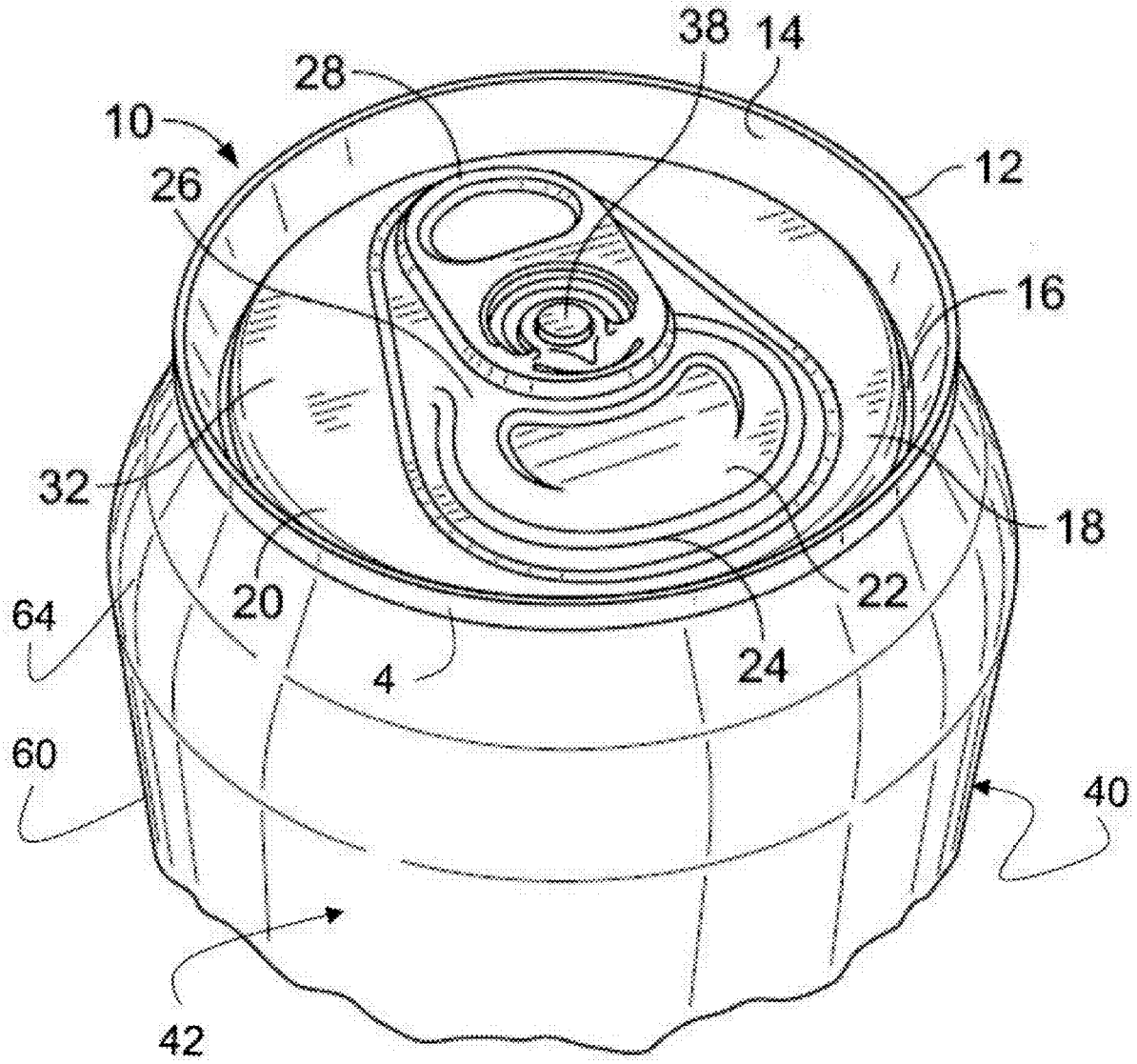
FIG. 4 is a partial elevational view of a beverage container of the present disclosure.
Figure 5:
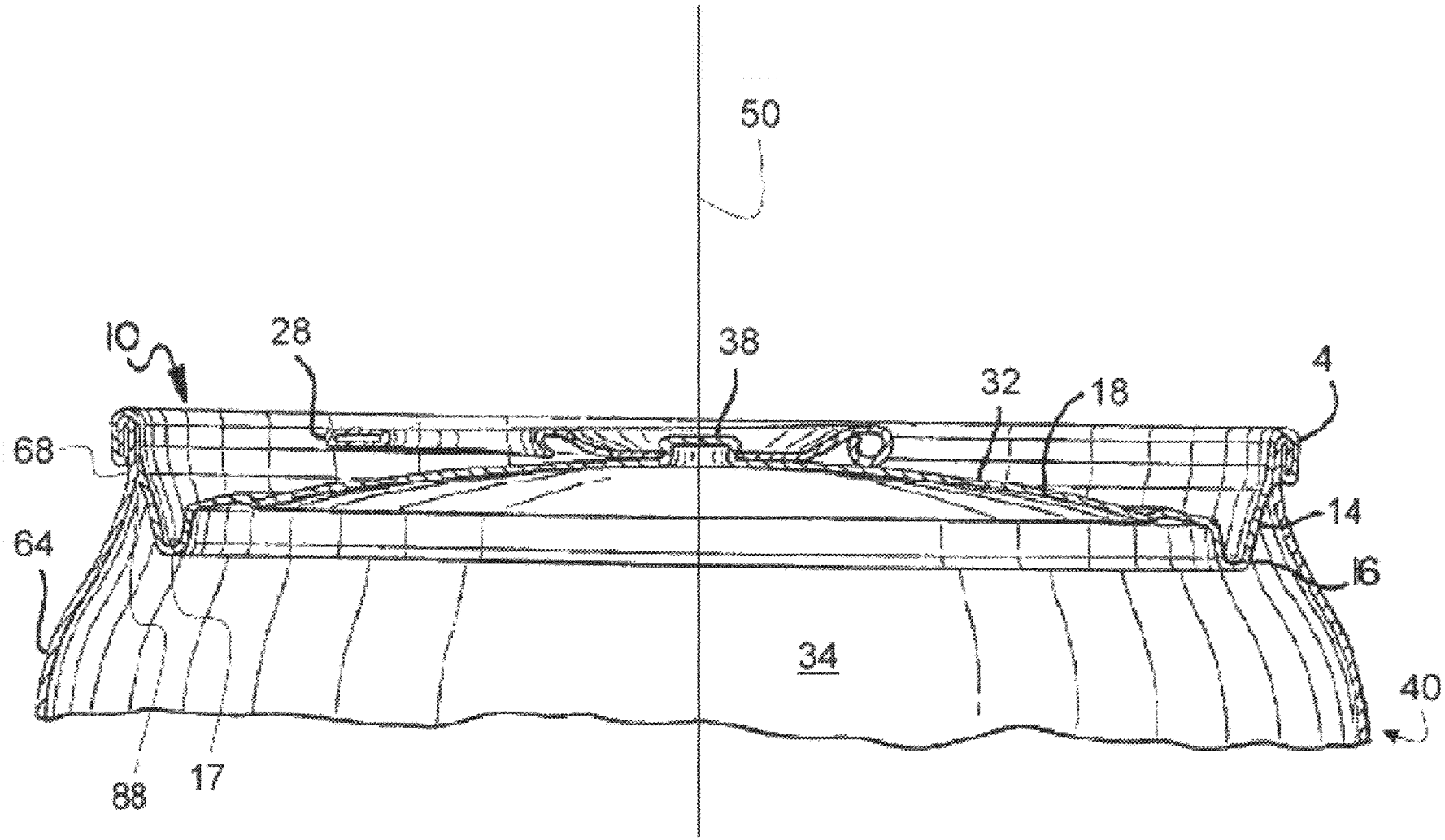
FIG. 5 is a partial cross-sectional view of a beverage container of the present disclosure.
Figure 6:
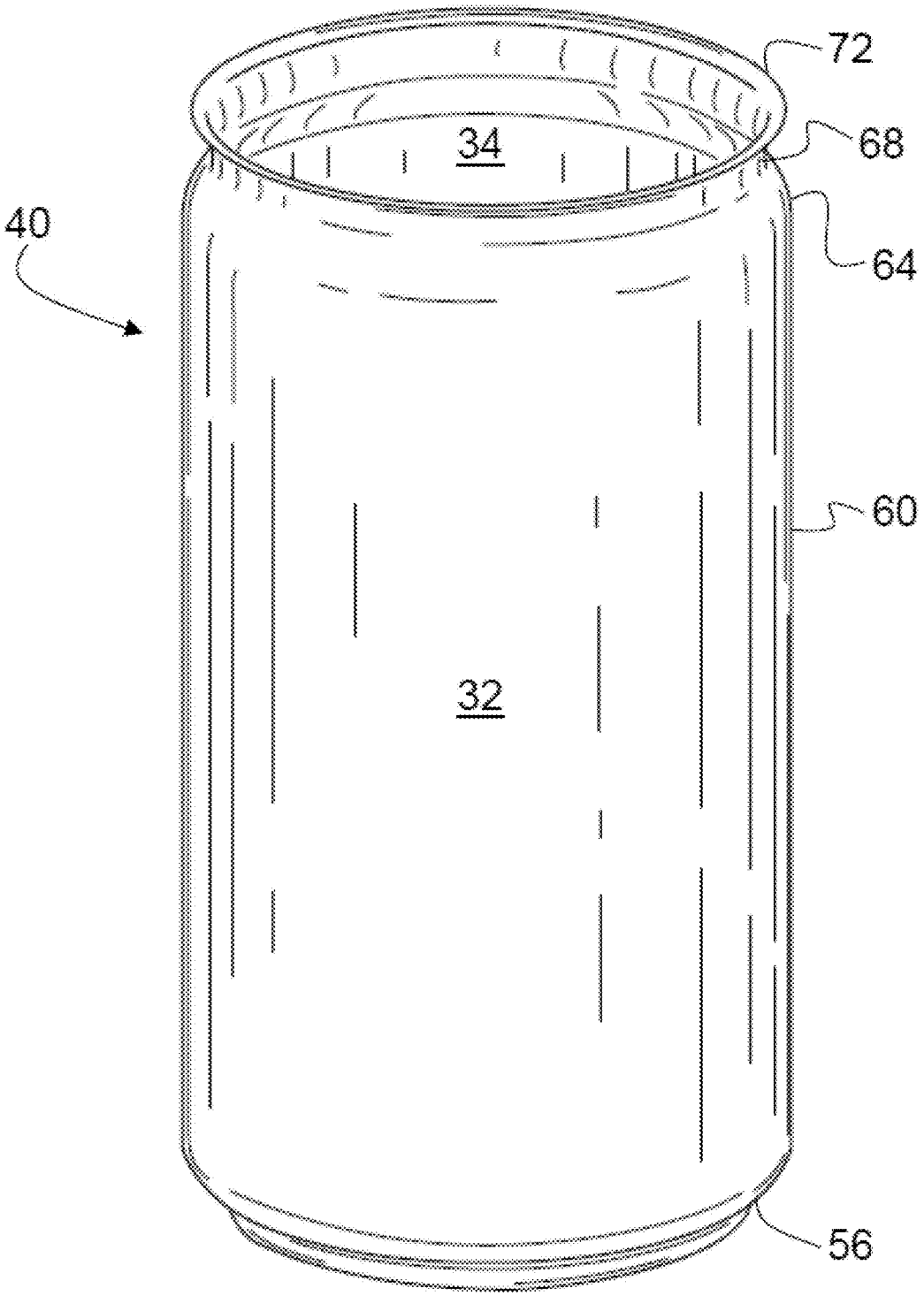
FIG. 6 is an elevational view of a can body of the present disclosure.

Referring to FIGS. 4 through 6, containers 1 of the present invention are generally of a two-piece construction. A can end 10 or lid is attached to a can body 40 in a seaming process. The can ends 10 are attached by a seam, preferably a double seam 4 to the can body 40. According to the disclosure, a very particular can end 10 and a very particular can body 40 are described as examples; however, principles of the disclosure can be transferred more generally to can ends and can bodies having other structural configurations.

As shown in FIGS. 4 and 5, typical can ends 10 for beverage containers have a circumferential curl 12, a circumferential chuckwall 14, a generally U-shaped circumferential countersink 16, and a center or central panel wall 18 extending radially outwardly from a central longitudinal axis 50.

The can end 10 is joined to the can body 40 by the curl 12 which is joined to a mating flange of the can body 40. The seaming curl 12 of the can end 10 is integral with the chuckwall 14 which is joined to a radially outer peripheral edge portion 20 of the center panel 18 by the countersink 16. This type of means for joining the can end 10 to a can body 40 is presently the typical means for joining used in the industry. The curl 12 terminates at a cutedge 13 of the metal used to form the can end 10.

The center panel 18 has a means for opening the can end 10. The means for opening the can end 10 may include a displaceable closure member such as a membrane or thin foil or, as shown in FIGS. 4 and 5, a tear panel 22 defined by a curvilinear frangible score 24 and a non-frangible hinge segment 26. The hinge segment 26 is defined by a generally straight line between a first end and a second end of the frangible score 24. The tear panel 22 of the center panel 18 may be opened, that is the frangible score 24 may be severed and the tear panel 22 displaced at an angular orientation relative to the remaining portion of the center panel 18, while the tear panel 22 remains hingedly connected to the center panel 18 through the hinge segment 26. In this opening operation, the tear panel 22 is displaced at an angular deflection as it is opened by being displaced away from the plane of the panel 18.

The frangible score 24 is preferably a generally V-shaped groove formed into a public side 32 of the center panel 18. A residual is formed between the V-shaped groove and a product side 34 of the end member 10.

The illustrated opening means has a tab 28 secured to the center panel 18 adjacent the tear panel 22 by a rivet 38. The rivet 38 is formed in the typical manner. Often, and as illustrated, the opening means is recessed within a deboss panel.

The countersink 16 is located about the peripheral edge 20 of the center panel 18. Accordingly, the countersink 16 extends circumferentially about the center panel 18. The countersink 16 extends radially outwardly from the peripheral edge 20 of the center panel 18 and joins the center panel 18 with the chuckwall 14.

The countersink 16 is generally U-shaped. Here, generally U-shaped is intended to encompass a structure having a concave bead as viewed from the public side 32. This concave bead has a portion which defines the lowermost extent of the can end 10.

The chuckwall 14 joins the countersink 16 with the curl 12 so that an uppermost portion of the chuckwall 14 is directly connected to the curl 12 and a lowermost portion of the chuckwall 14 is directly connected to the countersink 16. Accordingly, the chuckwall 14 extends upwardly from the countersink 16. The chuckwall 14 may be angled outwardly relative to the longitudinal axis 50 or have an arcuate segment.

These types of can ends 10 have been used for many years, with a large majority of such ends in use today being the "ecology" or "stay-on-tab" ("SOT") ends in which the tab 28 remains attached to the end after a tear panel 22.

Again, these can ends 10 are typically manufactured from a sheet of a metal substrate, such as an aluminum alloy, tin plated steel, or tin free steel. The metal sheet may have a cured protective coating on the upper and lower surfaces, i.e. the public and product sides 34, such as epoxies, acrylic epoxies, polyolefin dispersions, and polyethylene laminates. The protective coating protects the metal of the can end 10 from corrosion, either during processing or during storage of the packaged product. Any oxidation, corrosion or rust on the surface of the can end 10 is unacceptable to can manufacturers in general.

Referring to FIGS. 4 through 6, a can body 40 has a lower portion and an upper portion. When seamed to a can end 10, the product sides 34 of the upper and lower portions of the can body 40 together with the product side of the can end create a containment space 42 (see, e.g., FIG. 5) for holding a liquid beverage. The lower portion includes an enclosed bottom 56 and a cylindrical sidewall 60 extending upwardly from the enclosed bottom 56 portion.

The bottom 56 has a dome-shaped center panel surround by a generally a circumferential annular support. An outer wall extends radially outwardly and upwardly relative to the annular support and joins the bottom 56 with the lowermost portion of the cylindrical sidewall 60.

The cylindrical sidewall 60 is centered about the longitudinal axis 50. In the embodiments illustrated the sidewall 60 is smooth and flat. However, one of ordinary skill in the art would appreciate that any one of a number of forming techniques could be employed to impart a shape and/or texture to the sidewall 60. For instance, the interior of the sidewall 60 could be forced outwardly by a fluid pressure or forming segments, laser treatment could be employed to etch or otherwise mark the sidewall 60, and/or flutes or other designs may be imparted onto the sidewall 60 through mechanical deformation of the sidewall 60.

The upper portion includes a circumferential shoulder 64 portion. The shoulder 64 has a convexly curved appearance when viewed from the public side 32 of the container 1. The shoulder 64 has a lowermost point integral with an uppermost portion of the cylindrical sidewall. The transition point between the sidewall 60 and shoulder 64 is at a point where the can body 40 begins to curve radially inwardly. Stated another way, the diameter of the can body 40 begins to decrease at the point where the shoulder 64 begins and the sidewall 60 ends.

The upper portion further includes a neck 68. The neck 68 has a lowermost portion integral with an uppermost portion of the shoulder 64. The neck 68 is preferentially substantially flat, i.e. primarily free of an arc-shape design, although it may have some discontinuity formed during production. A diameter of the can body 40 in the neck 68 is relatively constant.

The upper portion also includes a radially outwardly extending flange 72 located above the neck 68. This flange 72 is integral with an uppermost portion of the neck 68. The flange 72 has a convex appearance when viewed from a vantage point above the can body 40, i.e. looking down at the open end of the can body 40.

Figure 7:
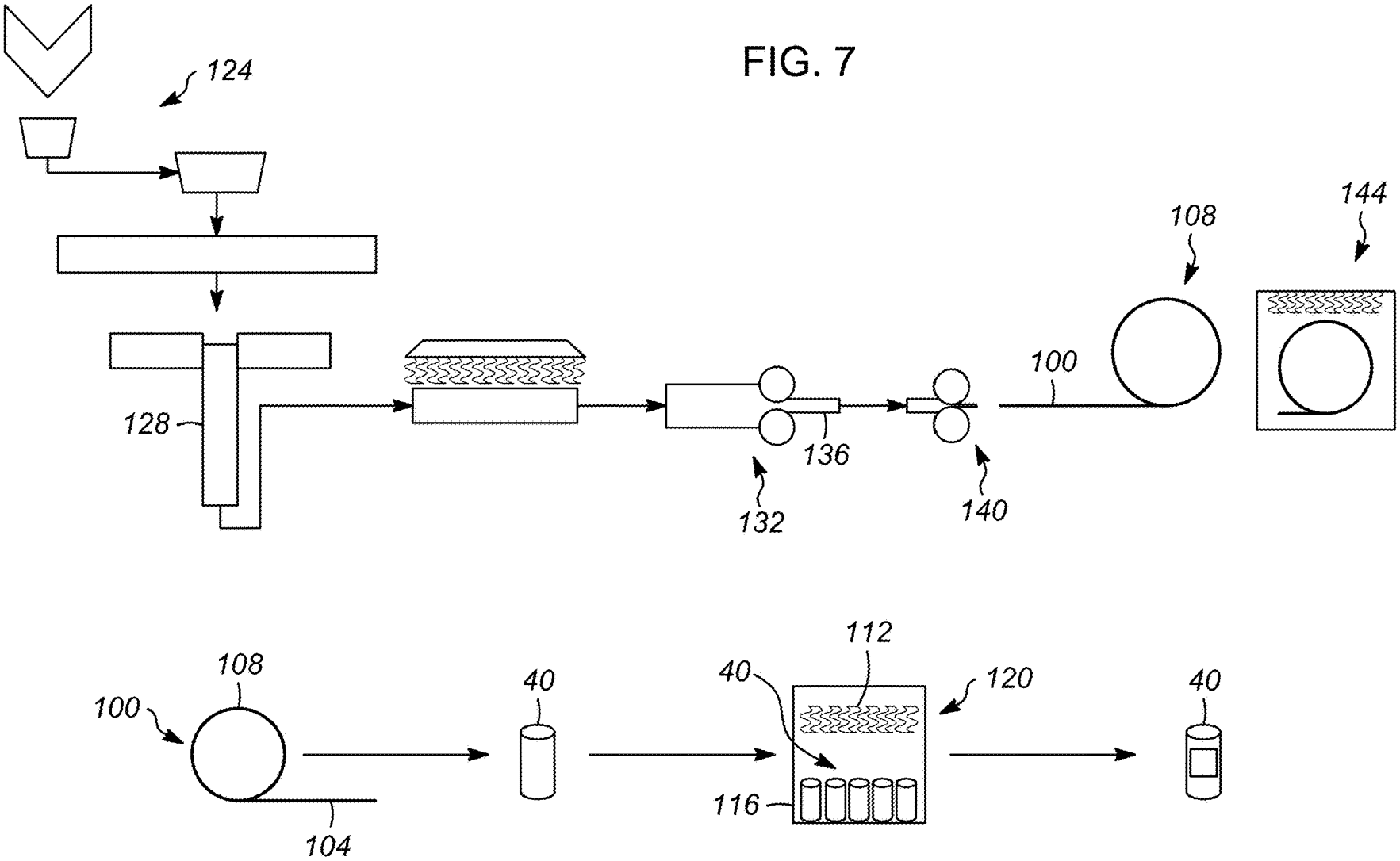
FIG. 7 is a schematic representation of a process for manufacturing can body metal alloy stock and a can body according to the present disclosure.
Figure 8:
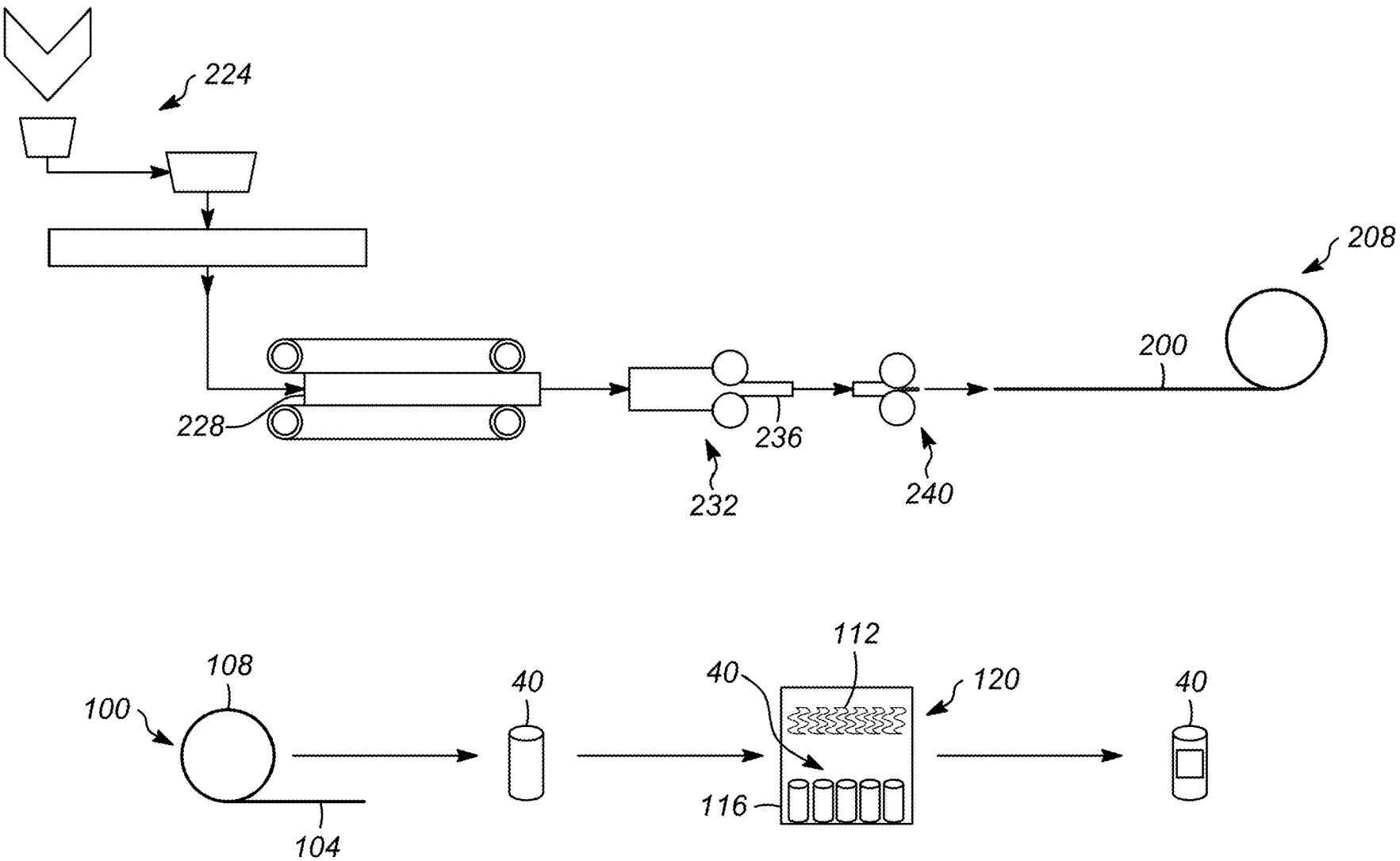
FIG. 8 is a schematic representation of a process for manufacturing can body metal alloy stock and a can body according to the present disclosure.
Figure 9:
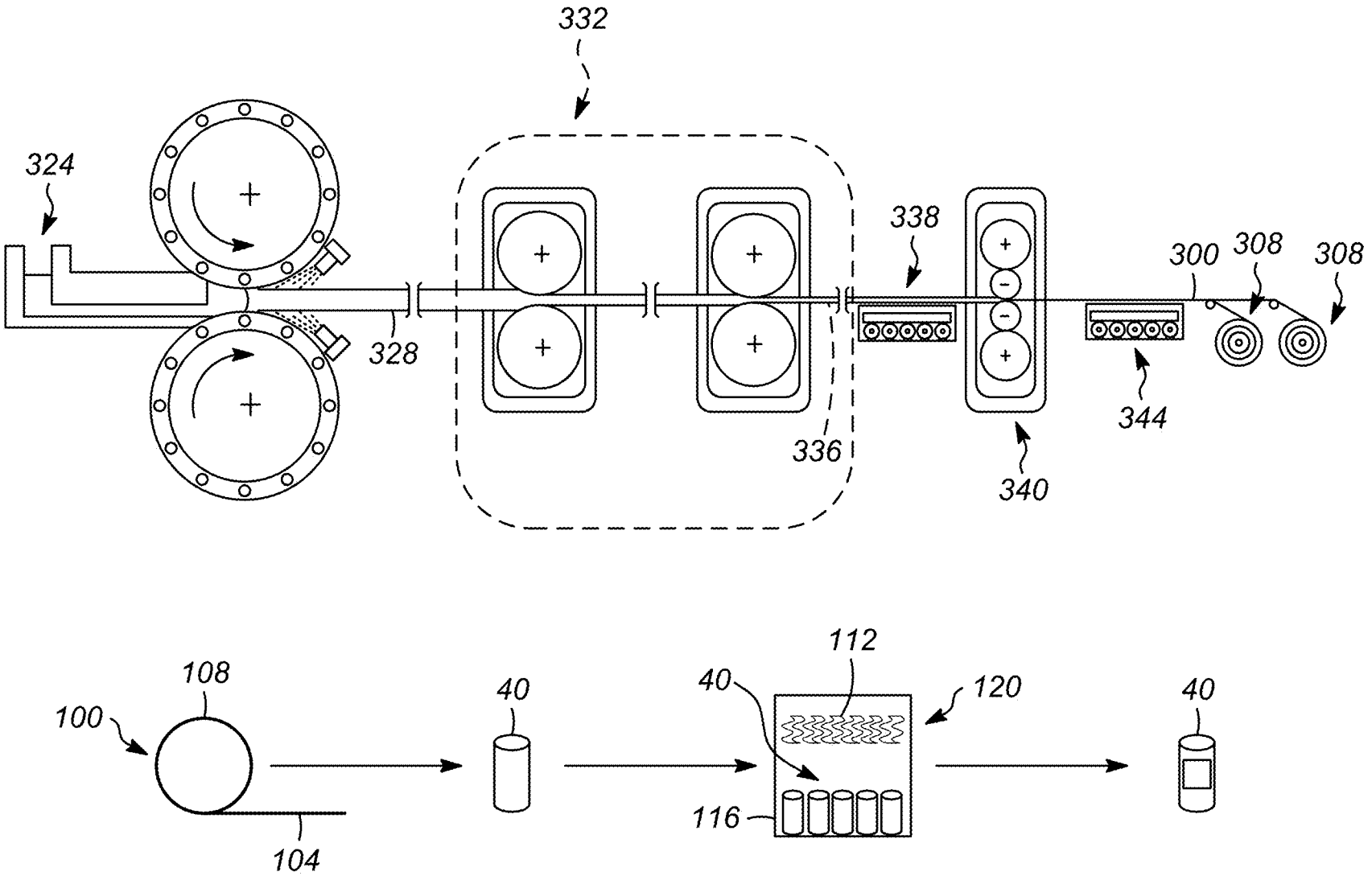
FIG. 9 is a schematic representation of a process for manufacturing can body metal alloy stock and a can body according to the present disclosure

As illustrated in FIGS. 7-9, processes for manufacturing an aluminum alloy comprise forming a can body from a metal alloy 100,200,300. The can body can be any can body known or unknown in the industry but is preferably a can body as described herein and shown in the drawings. The metal alloy is preferably an aluminum alloy such as those set out in Table 1 of the drawings (FIG. 15A-15M).

Can body manufacture is well-known in the art. The present disclosure employs the standard industry practice of production, which will not be discussed in detail in this disclosure. A sheet of aluminum 104,204,304 is fed from an aluminum alloy coil 108,208,308 and through a series of forming and cleaning processes, and a can body 40 as described above is produced. According to the present disclosure, one or more can bodies 40 are subjected to a thermal energy 112 from a source of heat 116, for example an oven. This process is an artificial aging step 120 wherein a temperature of the can body 40 is elevated and held at temperature, e.g. a temperature greater than an ambient temperature, preferably between 100° F. and 600° F. (38° C. to 316° C.), more preferably between 150° F. and 500° F. (66° C. to 260° C.), still more preferably between 225° F. and 350° F. (107° C. to 177° C.), and most preferably between 240° F. and 460° F. (116° C. and 238° C.), with a tolerance of +/−37° F. (3° C.), for a specified time. Typically, higher temperatures require less holding time. The literature states a temperature range from about 250° F. to 500° F. (121° C. to 260° C.). However, it appears that longer hold times at lower temperatures lead to higher strengthening potential. Based on the fact that beverage container component manufacturing is fast passed, this disclosure is aimed at performing this step on the higher temp/lower aging time of the spectrum.

Once the can body 40 is age hardened in this manner, the can body 40 is cooled and may be subjected to further processing such as decoration where ink or other adornments are added to the can body 40.

Figure 13:
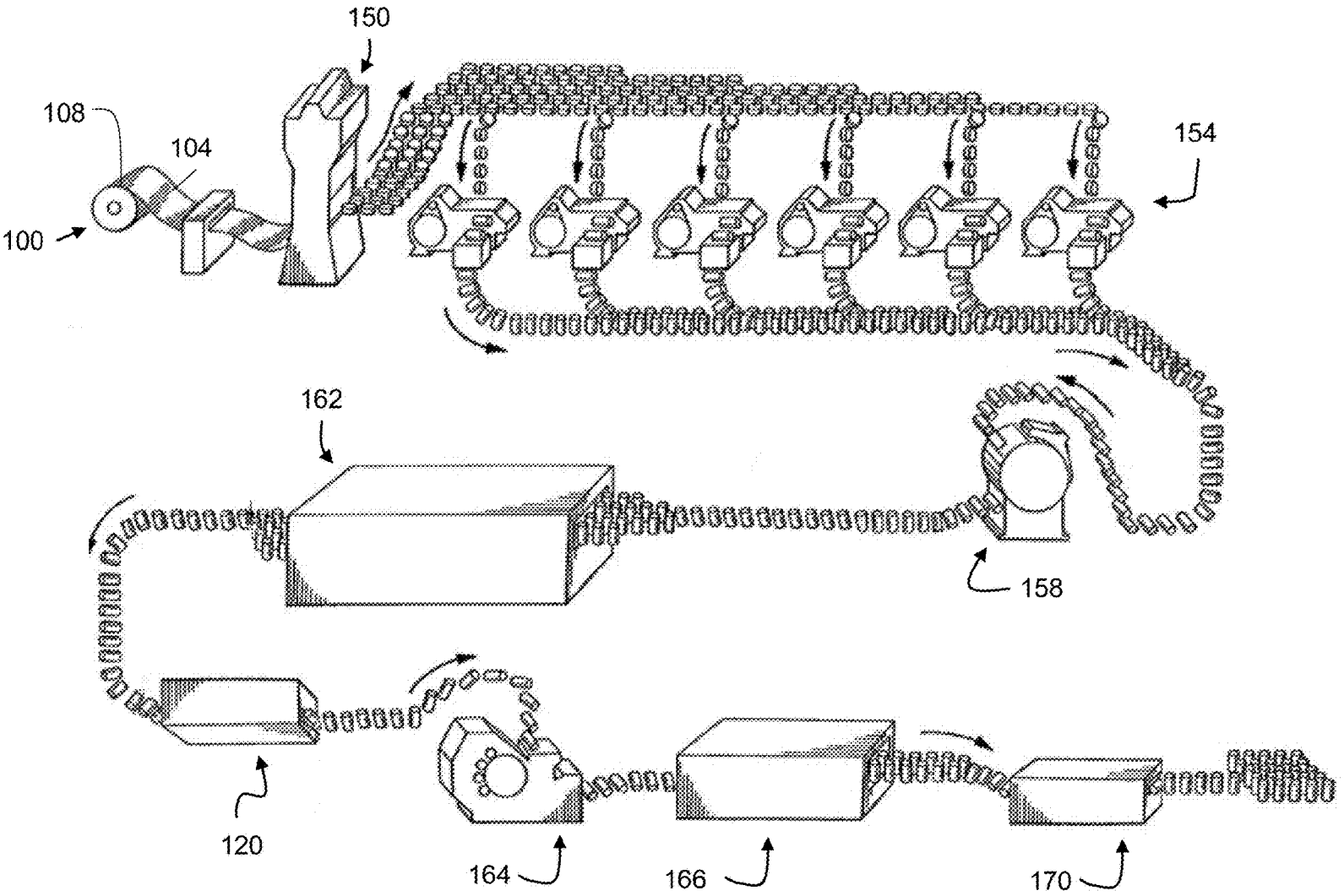
FIG. 13 is a schematic representation of a can body manufacturing facility.

In conventional can body 40 manufacturing, the open end of the can body is necked and flanged to the structure illustrated in FIG. 6, featuring the shoulder 64, neck 68, and flange 72. The multi-stage necking and flanging operation is typically performed after the can body 40 has been decorated and after the product side 34 of the can body 40 has been coated and the coating cured with heat. It is believed that the curing temperature and time softens the material of the can body 40, making the can body 40 easier to neck and flange. According to the present disclosure, the aging step 120 may be performed prior to decoration. However, this aging step 120 could make the necking and flanging operation more difficult. Thus, it is further contemplated that the aging step 120 could be performed subsequent to the necking and flanging operation and prior to the decorating step as illustrated in FIG. 13. Alternatively, according to FIG. 14, the aging step 120 can be performed after a draw and iron step 154 and prior to a decoration step 164 with the necking and flanging step 158 occurring after decorating.

According to an embodiment of the disclosure illustrated in FIG. 13, a coil 108,208,308 of the unialloy 100,200,300 delivers a sheet 104,204,304 to a blanking and cupping 150 operation where flat sheet 104 is formed into a shallow cup. The shallow cups are delivered to a draw and iron station 154 where the cups are reformed into a deeper cup or pre-body having an open end, a cylindrical sidewall, and an integral bottom. The drawn and ironed pre-bodies are delivered to a necking and flanging station 158 where the shoulder 64 of reducing diameter, neck 68, and radially outwardly curled flange 72 are formed into an at least substantially finished can body shape illustrated in FIG. 6. The can bodies 40 are then cleaned and dried at a cleaning station 162. The can bodies 40 are transferred to the aging step 120. After the aging step 120, the can bodies are decorated at a decorating station 164 the decorations are cured at a curing station 166 and internal coating is applied at a coating station 170.

Figure 14:
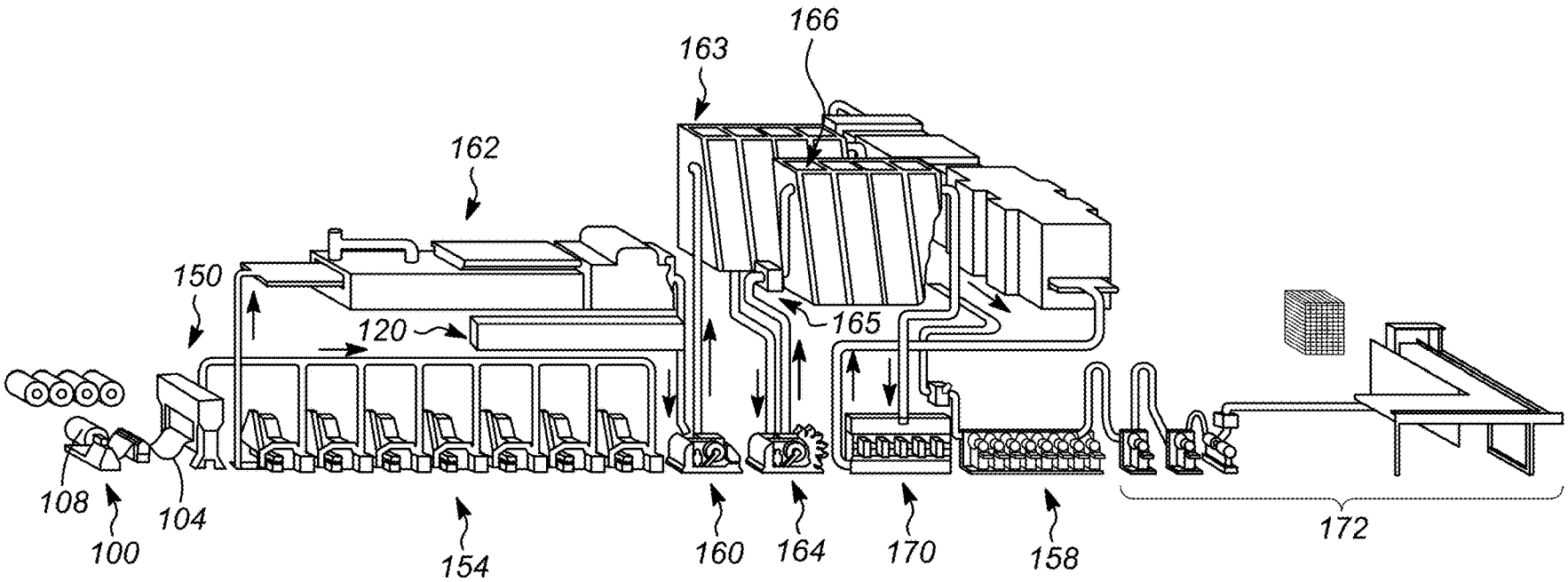
FIG. 14 is a schematic representation of an alternative can body manufacturing facility.

According to an embodiment of the disclosure illustrated in FIG. 14, a coil 108,208,308 of the unialloy 100,200,300 delivers a sheet 104,204,304 to a blanking and cupping 150 operation where flat sheet 104 is formed into a shallow cup. The shallow cups are delivered to a draw and iron station 154 where the cups are reformed into a deeper cup or pre-body having an open end, a cylindrical sidewall, and an integral bottom. The drawn and ironed pre-bodies are delivered to a cleaning station 162 then heat during and aging step at an aging station 120. After the aging step 120, the heat treated pre-bodies are optionally transferred to a basecoating station 160 where the pre-bodies can be basecoated then cured at a basecoating cure station 163. The optionally basecoated pre-bodies are then delivered to a decorating station 164 for inking, bottom coated at a bottom coating station 165 and cured at a deco cure station 166. After that, an interior surface of the can bodies is coated and cured at a coating station 170. The coated pre-bodies are transferred to a necking and flanging station 158 where the reduced diameter neck and curl are formed to produce the can body described above, then the bottoms are reformed, the can bodies are inspected, the palletized 172.

Typically, age hardening can be speeded up or slowed down based on the temperature of the process. As success of can-making is often related to the speed at which the beverage containers are produced, it is beneficial to perform this age hardening at temperatures higher within the range.

Preferably, the aging step 120 is performed prior to decoration and interior surface coating steps.

An advantage of the present disclosure is the increased strength that the aging step provides subsequent to cold working the aluminum alloy during the cupping and drawing and ironing steps. For example, column strength of a can body may be increased 20%. Additional strength improvements may be gained by incorporating the aging step 120 subsequent to cupping, drawing and ironing, and necking and flanging. A benefit of the added strength is that thickness of the aluminum alloy sheet used to produce the can bodies can be reduced below 0.24 mm (0.0094 inches).

Prior to the can body forming processes, the metal stock, i.e., the aluminum sheet, in coil form is manufactured, typically at an integrated aluminum manufacturing facility. This process includes melting a combination of recycled or scrap aluminum and some virgin aluminum 124,224,324, but preferably up to 100% recycled aluminum materials. A composition of the molten metal is refined by adding alloying elements, fluxing, settling, degassing, filtration, grain refinement, and composition testing as required to produce a suitable metal alloy. The molten metal in liquid form is poured and cast into slabs, plates, or sheet 128,228,328. Subsequently, the slabs, plates, or sheet 128,228,328 may be optionally reheated as needed into reheated form and hot rolled 132,232,332 which decreases the thickness of the slabs or plates 128,228 from several inches to fractions of an inch. The hot rolled metal alloy 136,236,336 may be cooled and cold rolled 140,240,340 where final surface quality and thickness is achieved, and the metal alloy sheet is wound into the coil 108,208,308. Optionally, the plates or sheet or sheet 228,328 and/or the hot rolled metal alloy 136,236,336 may be annealed 338 prior to cold rolling 140,240,340. The optional hot rolling step is indicated by dashed lines in the drawings. Subsequent to cold rolling, the metal alloy sheet may be subjected to a solid solution heat treatment 144,244,344, wherein the metal sheet is typically heated in the range of 450° C. to 575° C. (842° F. to 1067° F.) in a fluid atmosphere, e.g. a gas, such as air, followed by rapid quenching in a fluid atmosphere, e.g. a liquid, such as water, oil, salts, mist, etc., or any combination of same. It is further contemplated that the solid solution heat treatment can take place during or after cold rolling.

The solid solution heat treatment temperature is dependent on the specific alloy.

Figure 10:
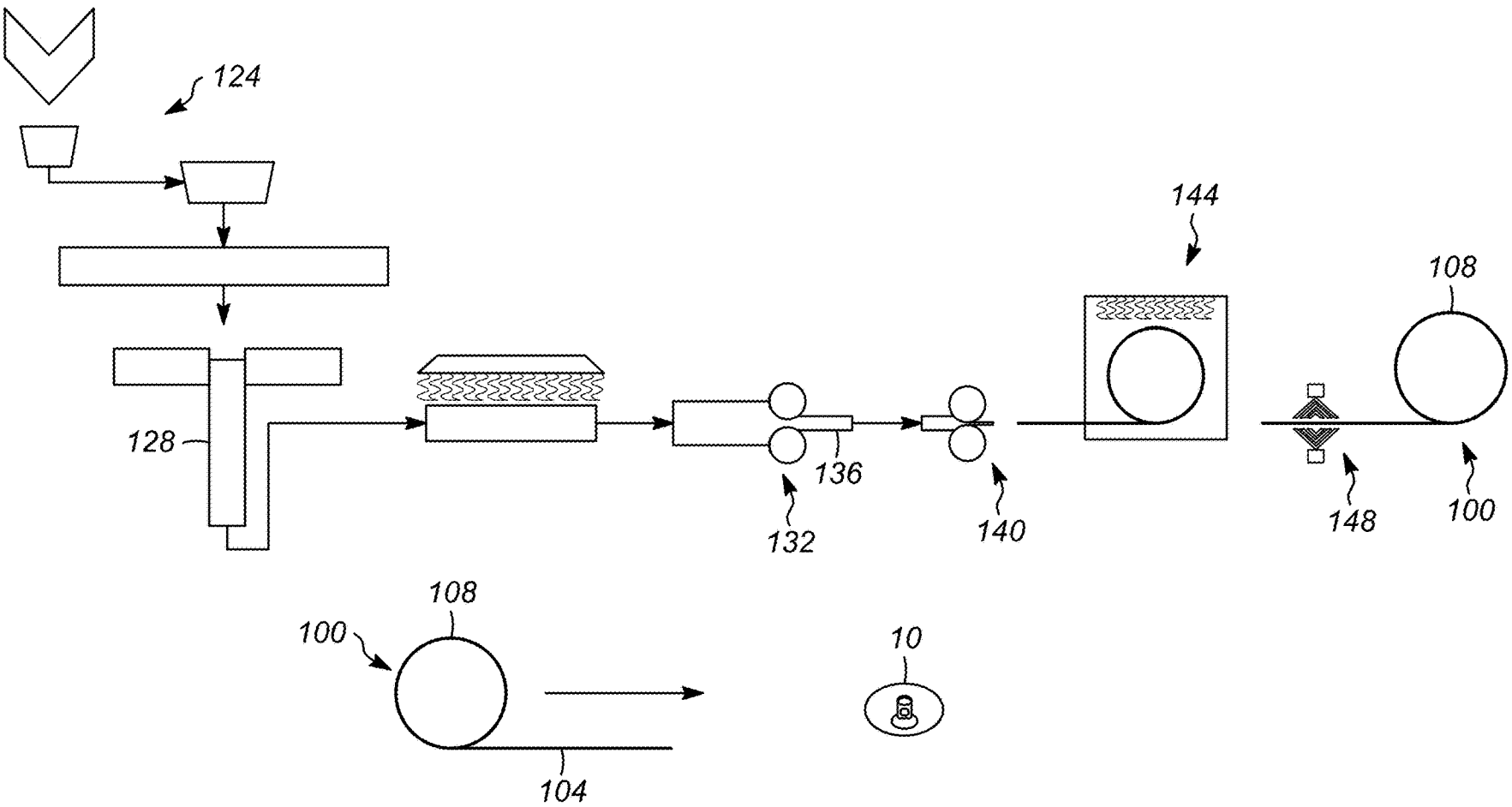
FIG. 10 is a schematic representation of a process for manufacturing can end metal alloy stock and a can end according to the present disclosure.
Figure 11:
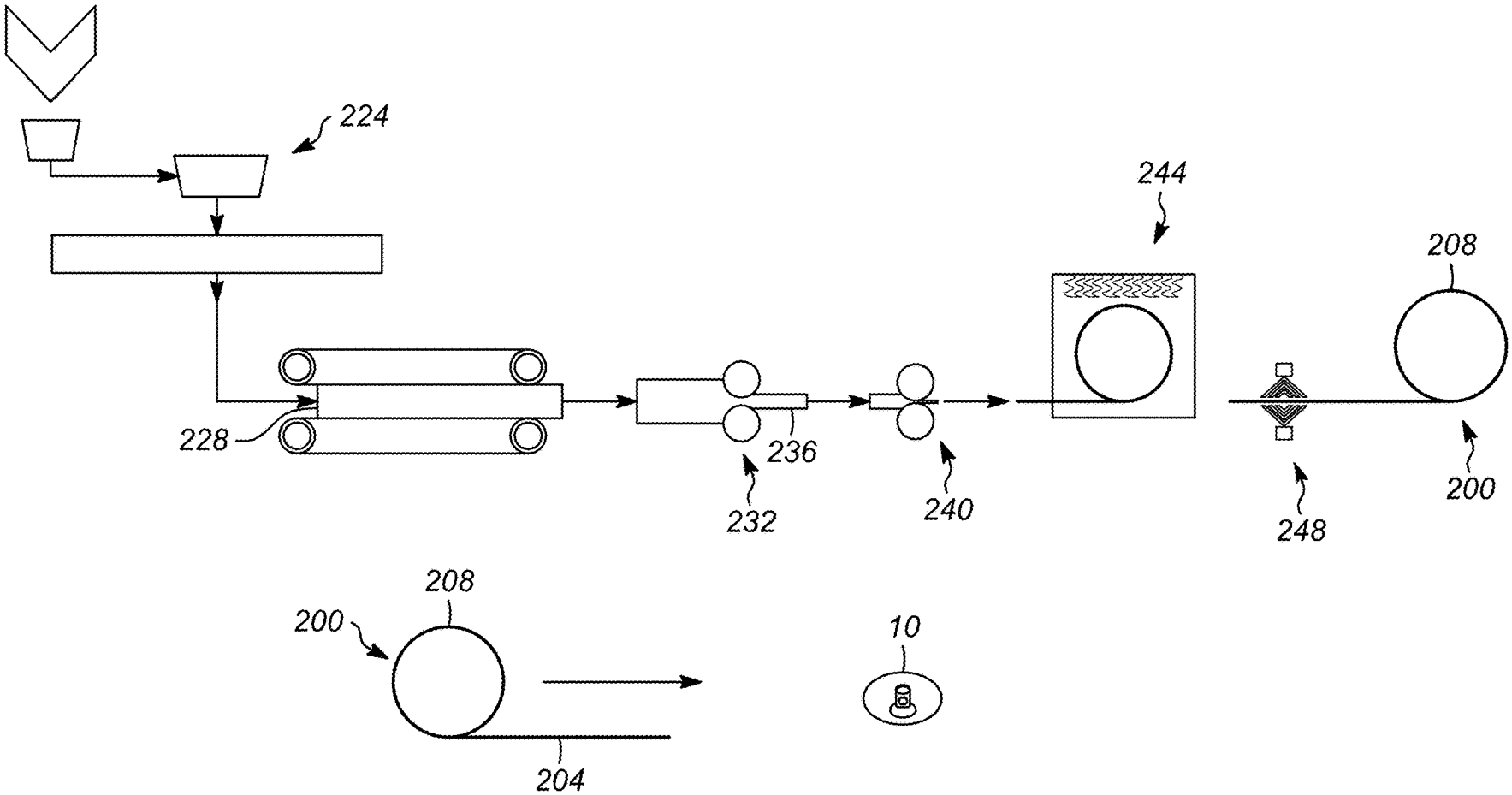
FIG. 11 is a schematic representation of a process for manufacturing can end metal alloy stock and a can end according to the present disclosure.
Figure 12:
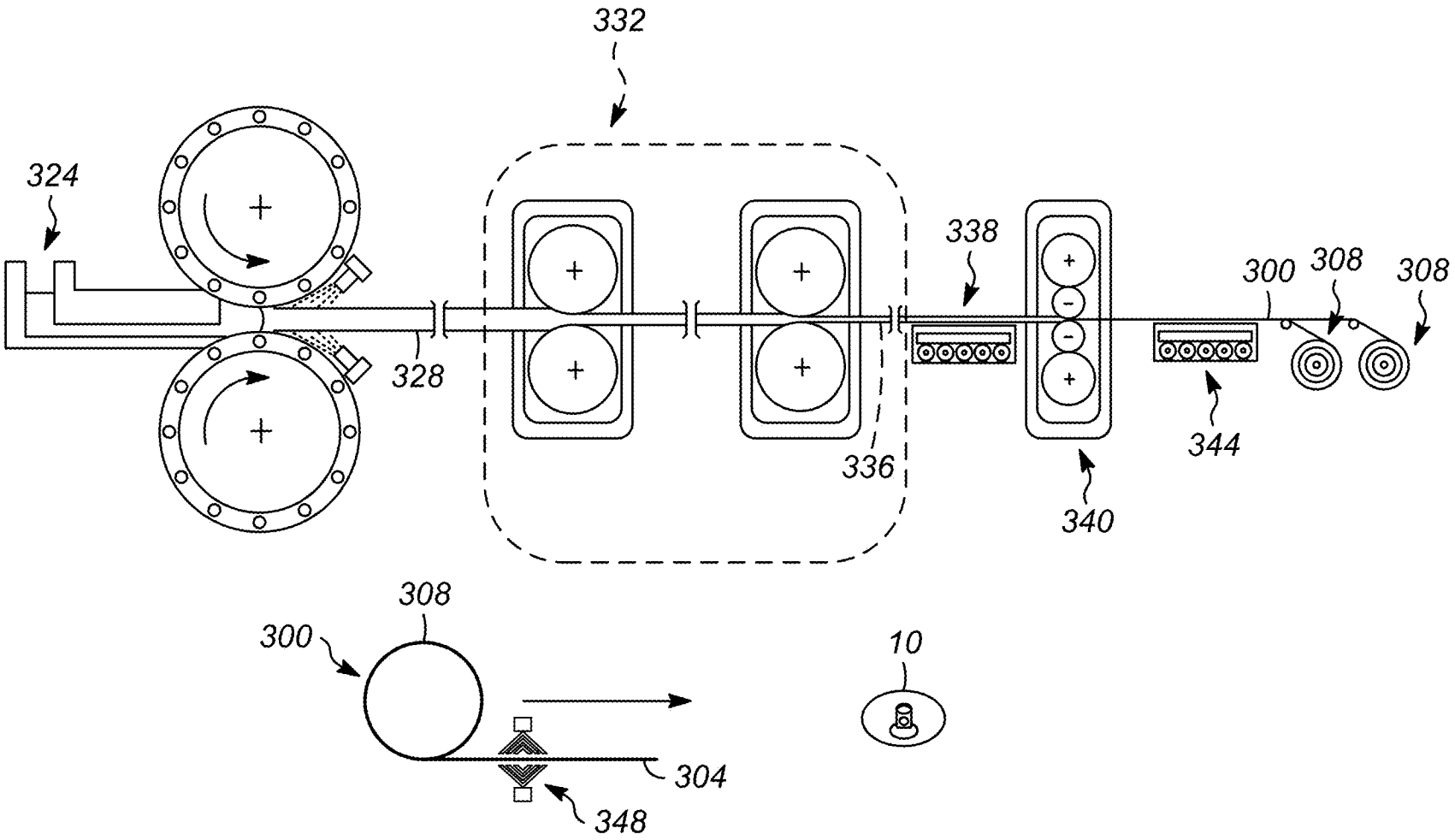
FIG. 12 is a schematic representation of a process for manufacturing can end metal alloy stock and a can end according to the present disclosure.

As illustrated in FIG. 10-12, processes for manufacturing an aluminum alloy comprise forming a can end 10 from a substantially compositionally identical metal alloy 100,200,300 to the metal alloy 100,200,300 provided to produce the can body 40. The can end can be any can end known or unknown in the industry but is preferably a can end as described herein and shown in the drawings. The substantially compositionally identical metal alloy 100,200,300 is preferably an aluminum alloy such as those set out in Table 1 of the drawings.

Can end manufacture is well-known in the art. The present disclosure employs the standard industry practice of production, which will not be discussed in detail in this disclosure. A sheet of aluminum 104,204,304 is fed from an aluminum alloy coil 108,208,308 and through a shell press, formed into a shell, then finished in a conversion press with the tab formed and joined to the can end in the conversion press. By this process, a can end 10 as described above is produced. The aluminum sheet 104 may be coated or uncoated. It is more typically coated.

Prior to the can end forming processes, the metal stock, i.e., the aluminum sheet, in coil form is manufactured, typically at an integrated aluminum manufacturing facility. This process includes melting a combination of recycled or scrap aluminum and some virgin aluminum 124,224,334, but preferably up to 100% recycled aluminum materials. A composition of the molten metal is refined by adding alloying elements, fluxing, settling degassing, filtration, grain refinement, and composition testing as required to produce a suitable metal alloy. The molten metal in liquid form is poured and cast into slabs, plates, or sheet 128,228,328. Subsequently, the slabs, plates, or sheet 128,238,328 are reheated as needed into reheated form and hot rolled 132, 232,332 which decreases the thickness of the slabs or plates 128 or 228 from several inches to fractions of an inch. The hot rolled metal alloy 136,236,336 may be cooled and cold rolled 140,240,340 where final surface quality and thickness is achieved, and the metal alloy sheet is wound into the coil 108,208,308. Optionally, the plates or sheet 228,328 and/or the hot rolled metal alloy 136,236,336 may be annealed 338 prior to cold rolling 140,240,340. The optional hot rolling step is indicated by dashed lines in the drawings Following the cold rolling step 140,240,340, the metal alloy sheet 104,204,304 may be subjected to a solid solution heat treatment and/or aging step 144,244,344. During the solid solution heat treatment 144,244,344, the metal alloy sheet 104,204,304 is typically heated in the range of 450° C. to 575° C. (842° F. to 1067° F.) in a fluid atmosphere, e.g. a gas, such as air, followed by rapid quenching in a fluid atmosphere, e.g. a liquid, such as water, oil, salts, mist, etc., or any combination of same. It is further contemplated that the solid solution heat treatment can take place during or after cold rolling. This temperature range is alloy dependent; however, in the case of the present disclosure, it should be understood that the use of the unialloy allows that the ranges for the different heat treatments will be the same regardless of the beverage container component, e.g. can body, can end, or tab.

The heat treatment temperature is dependent on the specific alloy.

During the aging step, a temperature of the can end metal alloy sheet 104,204,304 is elevated and held at temperature, e.g. a temperature greater than an ambient temperature, preferably between 100° F. and 600° F. (38° C. to 316° C.), more preferably between 150° F. and 500° F. (66° C. to 260° C.), still more preferably between 225° F. and 350° F. (107° C. to 177° C.), and most preferably between 240° F. and 460° F. (116° C. and 238° C.), with a tolerance of +/−37° F. (3° C.), for a specified time for a specified time. The literature states a temperature range from about 250° F. to 500° F. (121° C. to 260° C.). However, it appears that longer hold times at lower temperatures lead to higher strengthening potential. Based on the fact that beverage container component manufacturing is fast passed, this disclosure is aimed at performing this step on the higher temp/lower aging time of the spectrum. This aging step can take place in coil form at the aluminum supplier's manufacturing facility, at the can end manufacturing plant, or at some other third party processor facility.

Once the can end metal alloy sheet 104,204,304 is age hardened in this manner, the can end metal alloy sheet 104,204,304 is cooled and a coating step 148,248,348 is carried where a coating is applied to the metal alloy sheet 104,204,304 in the conventional manner known in the art of can end manufacture.

While the specific embodiments have been illustrated and described, numerous modifications come to mind without significantly departing from the spirit of the invention, and the scope of protection is only limited by the scope of the accompanying Claims.

What is claimed is:

1. A method of forming a beverage container comprising the steps of:

forming a can body from a metal alloy;

forming a can end from a substantially compositionally identical metal alloy; and heat treating the metal alloy after the step of forming the can body, wherein the metal alloy and the substantially compositionally identical metal alloy are selected from the group consisting of a 4XXX, a 6XXX, a 2XXX, and a 7XXX aluminum alloy.

2. The method of claim 1 further comprising the step of heat treating the substantially compositionally identical metal alloy.

3. The method of claim 2 wherein the heat treating step the substantially compositionally identical metal alloy is performed prior to the the forming the can end step.

4. The method of claim 1 wherein the step of heat treating the metal alloy is an age hardening performed between 225° F. and 350° F.

5. The method of claim 4 further comprising the steps of:

casting the metal alloy in a liquid state into one of a solid slab, plate, or sheet;

cold rolling a thin metal sheet to reduce a thickness of the thin metal sheet into a cold rolled metal alloy sheet;

coiling the cold rolled metal alloy sheet;

performing a solid solution heat treatment on the metal alloy prior to forming the can body.

6. The method of claim 5 wherein the performing the solid solution heat treatment step is performed one of before the cold rolling, during the cold rolling, or after the cold rolling step.

7. The method of claim 6 further comprising the steps of:

reheating the slab, plate or sheet into a reheated slab, plate of sheet; and hot rolling the reheated slab, plate or sheet to reduce a thickness of the reheated slab, plate, or sheet into the thin metal sheet.

8. A method of forming a beverage container can body comprising the steps of:

forming a shallow cup from a sheet of a metal alloy;

reforming the shallow cup into a pre-body having an open end, an elongated cylindrical sidewall, and an integral bottom;

reforming the pre-body into a can body comprising a circumferential shoulder of reducing diameter, a neck, and a radially outwardly curled flange;

aging the can body at an aging temperature greater than an ambient temperature for a duration of time, wherein the metal alloy is selected from the group consisting of a 4XXX, a 6XXX, a 2XXX, and a 7XXX aluminum alloy.

9. The method of claim 8 wherein the aging temperature is between 100° F. and 600° F.

10. The method of claim 9 wherein the aging temperature is between 150° F. and 500° F.

* * * * *